US006598962B2

(12) United States Patent
Okazawa et al.

(10) Patent No.: US 6,598,962 B2
(45) Date of Patent: Jul. 29, 2003

(54) INK JET RECORDING HEAD

(75) Inventors: Noriaki Okazawa, Nagano (JP); Takayuki Iijima, Nagano (JP); Hiroyuki Machii, Nagano (JP); Akihiko Kurashina, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/968,667

(22) Filed: Oct. 2, 2001

(65) Prior Publication Data

US 2002/0043213 A1 Apr. 18, 2002

(30) Foreign Application Priority Data

Oct. 2, 2000 (JP) ..... 2000-302038
Sep. 26, 2001 (JP) ..... 2001-293250

(51) Int. Cl.[7] ..... B41J 2/045
(52) U.S. Cl. ..... 347/68
(58) Field of Search ..... 347/68, 70, 71, 347/72

(56) References Cited

U.S. PATENT DOCUMENTS 5,956,058 A * 9/1999 Momose et al. ..... 347/71
6,048,053 A * 4/2000 Kamoi et al. ..... 347/70
6,139,132 A * 10/2000 Yasukawa et al. ..... 347/70
6,206,499 B1 * 3/2001 Iijima et al. ..... 347/68
6,332,671 B1 * 12/2001 Takahashi et al. ..... 347/68
6,460,981 B1 * 10/2002 Yasukawa et al. ..... 347/70
2002/0140782 A1 * 10/2002 Yasukawa et al. ..... 347/70

* cited by examiner

*Primary Examiner*—Judy Nguyen
(74) *Attorney, Agent, or Firm*—Sughrue Mion, PLLC

(57) ABSTRACT

In a vibrator unit, a plurality of piezoelectric vibrators are arranged on a base member in a cantilevered manner. A case is formed with a housing space having a bonding area at which a first inner portion of the housing space and a first face of the base member are opposed with a gap. At least one adhesive inlet, from which an adhesive is poured, communicates with the bonding area. At least one air outlet, from which air remaining in the bonding area is expelled as the poured adhesive fills the gap is provided.

13 Claims, 18 Drawing Sheets

INK JET RECORDING HEAD

BACKGROUND OF THE INVENTION

The present invention relates to an ink jet recording head suitably used for recording apparatuses such as printers and plotters, and more particularly, to an ink jet recording head in which a fixation base of a vibrator unit is bonded to a case.

Some related ink jet recording heads (hereinafter, referred to as recording heads for short) have a structure provided with: a vibrator unit in which a piezoelectric vibrator row is joined to a fixation base; a case in which a housing space capable of housing the vibrator unit is formed, and a channel unit joined to a distal end of the case.

The vibrator unit is a member formed by joining piezoelectric vibrators and the fixation base into a single unit. In this vibrator unit, the fixed ends of the piezoelectric vibrators are joined to the fixation base, for example, in a so-called cantilevered manner in which the free ends of the piezoelectric vibrators protrude outside a distal end face of the fixation base. The case is a block-shaped member molded of a synthetic resin and is provided with a flat housing space whose top and bottom are open and that has a size in which the vibrator unit is exactly fitted. The channel unit is a plate-shaped member having an interior of an ink channel communicating a common ink reservoir and a nozzle orifice via a pressure chamber.

To assemble this recording head, the channel unit is bonded to a distal end face of the case, and the vibrator unit is housed and fixed in the housing space of the case. The vibrator unit is fixed by bonding together the fixation base and a bonding wall formed inside the case. For example, a fluid adhesive is poured into a gap between bonding faces of the fixation base and the bonding wall, and the poured adhesive is cured.

In the recording head of this structure, it is of vital importance that the bonding area of the fixation base and the bonding wall, particularly, the area corresponding to the fixed ends of the piezoelectric vibrators contain no residual bubbles and are filled with the adhesive. This is because, if the adhesive is insufficiently filled in the bonding area and bubbles remain, the part corresponding to the residual bubbles is low in rigidity and this affects the behavior of the piezoelectric vibrators so that ink drop jetting characteristics such as the flying speed and the ink amount changes.

SUMMARY OF THE INVENTION

The present invention is made in view of these circumstances, and an object thereof is to provide an ink jet recording head in which bubbles remaining in the bonding area of the fixation base and the bonding wall are prevented.

In order to achieve the above object, according to the present invention, there is provided an ink jet recording head, comprising:

- a vibrator unit, in which a plurality of piezoelectric vibrators are arranged on a base member in a cantilevered manner;
- a case, formed with a housing space having a bonding area at which a first inner portion of the housing space and a first face of the base member are opposed with a gap;
- at least one adhesive inlet, from which an adhesive is poured, the adhesive inlet communicating with the bonding area; and
- at least one air outlet, from which air remaining in the bonding area is expelled as the poured adhesive fills the gap.

In this configuration, the gap in the bonding area is gradually filled by the influent adhesive from the side of the adhesive inlet while air in the bonding area is expelled toward the air outlet side, so that it can be prevented that air bubbles remain in the bonding area. Consequently, partial lack of rigidity in the bonding area can be prevented, so that the behavior of the piezoelectric vibrators can be made the same. As a result, ink drop jetting characteristics such as the flying speed and the ink amount can be stabilized.

Preferably, a pair of adhesive inlets are disposed so as to face both lateral side edge portions of the bonding area, and the air outlet is disposed between the adhesive inlets.

Alternatively, it is preferable that a pair of air outlets are disposed so as to face both lateral side edge portions of the bonding area, and the adhesive inlet is disposed between the air outlets.

Alternatively, it is preferable that the adhesive inlet is disposed so as to face one lateral side edge portion of the bonding area, and the air outlet is disposed so as to face the other lateral side edge portion of the bonding area.

Preferably, a dimension of the gap is so determined as to establish capillarity from the adhesive inlet to the air outlet.

In this configuration, the poured adhesive fills the gap in the bonding area from the side of the adhesive inlet toward the air outlet by a capillary force. Since the strength of the capillary force can be controlled, the adhesive filling speed in the bonding area can positively be controlled. Consequently, the air in the bonding area can reliably be expelled.

Here, it is preferable that the dimension of the gap is reduced as being away from the adhesive inlet and being close to the air outlet.

In this configuration, the capillary force of the adhesive increases with distance from the adhesive inlet. Consequently, the adhesive poured in the adhesive inlet can reliably be directed to the air outlet.

Preferably, a pair of rib members extending in a vertical direction is formed in the housing space, and disposed both lateral sides of the bonding area. Each of the rib members has a face which is in close contact with the first face of the base member. The adhesive inlet is disposed between the rib members.

In this configuration, since the poured adhesive is dammed by the rib members which are in close contact with the base member, the adhesive can be held in the bonding area. Consequently, the problem wherein the adhesive adheres to other parts can reliably be prevented.

Preferably, the recording head further comprises an adhesive reservoir provided between the adhesive inlet and the bonding area in order to store the poured adhesive temporarily.

In this configuration, it can be made difficult for the adhesive to flow out from the adhesive inlet even if the adhesive pouring speed is increased. This reduces the time necessary for the bonding step.

Here, it is preferable that a capacity of the adhesive reservoir is so determined as to store an amount of adhesive which is enough to fill the gap in the bonding area.

In this configuration, pouring of the adhesive can be finished only once. Consequently, the time necessary for the bonding step can be further reduced.

Preferably, a dimension of the gap at a portion where the bonding area communicates with the air outlet is determined such that the adhesive is held thereat due to surface tension thereof.

In this configuration, the adhesive in the bonding area can be prevented from flowing into the air outlet.

Preferably a second inner portion of the housing space which situates an upper portion of the first inner portion is retracted so as to be away from the base member fixed on the first inner portion, to form a non-bonding area. A top portion of the first inner portion is tapered so as to continue to the non-bonding area so that the gap thereat is enlarged toward the non-bonding area, thereby filling condition of the poured adhesive in the tapered portion can be externally confirmed.

Here, "upper" is defined as the side of which the case is attached to another member, whereas "lower" is thus defined as the side of which the nozzle orifice is provided.

In this configuration, whether the adhesive is filled in the entire bonding area or not can be determined based on the filling state of the adhesive in the tapered portion. Consequently, poor bonding can be prevented.

Preferably, a third inner portion of the housing space which faces the piezoelectric vibrators is protruded from the first inner portion so as to form a step portion on which a second face of the base member is bonded. A corner portion of the step portion which is closer to the piezoelectric vibrators is recessed so as to be away from the piezoelectric vibrators.

Here, it is preferable that a part of the second face of the base member which faces the recessed corner portion of the step portion is recessed so as to be away from the corner portion.

In this configuration, the adhesive can be held in the step portion while the adhesive is prevented from reaching the piezoelectric vibrators.

BRIEF DESCRIPTION OF THE DRAWINGS

The above objects and advantages of the present invention, will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Hereinafter, preferred embodiments of the present invention will be described with reference to the drawings. First a recording head according to a first embodiment will be described.

Figure 1:
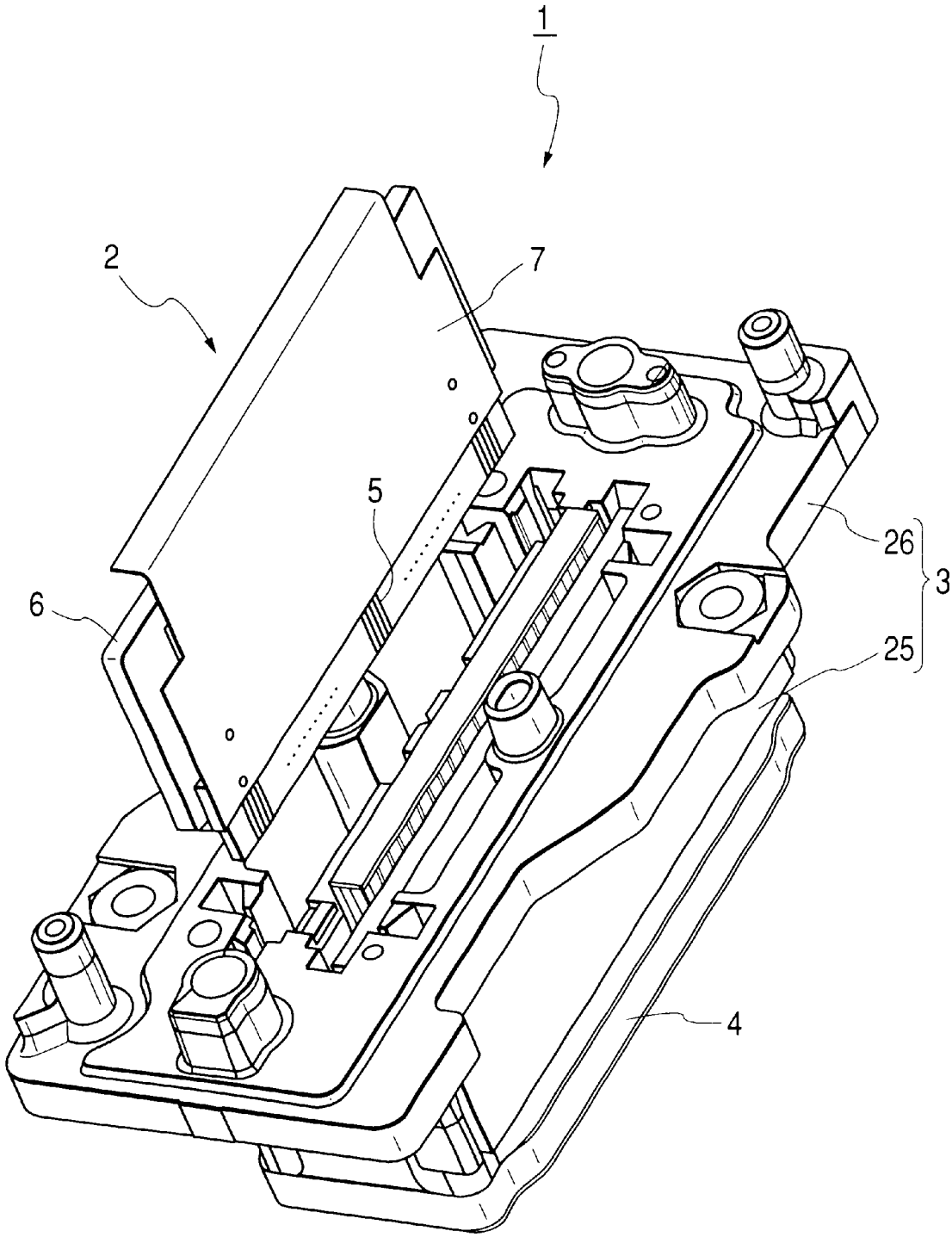
FIG. 1 is a perspective view of a recording head showing a state where a vibrator unit is taken out.

As shown in FIG. 1, the recording head 1 is provided with a vibrator unit 2, a case 3 capable of housing the vibrator unit 2, and a channel unit 4 joined to the distal end face of the case 3.

Figure 2:
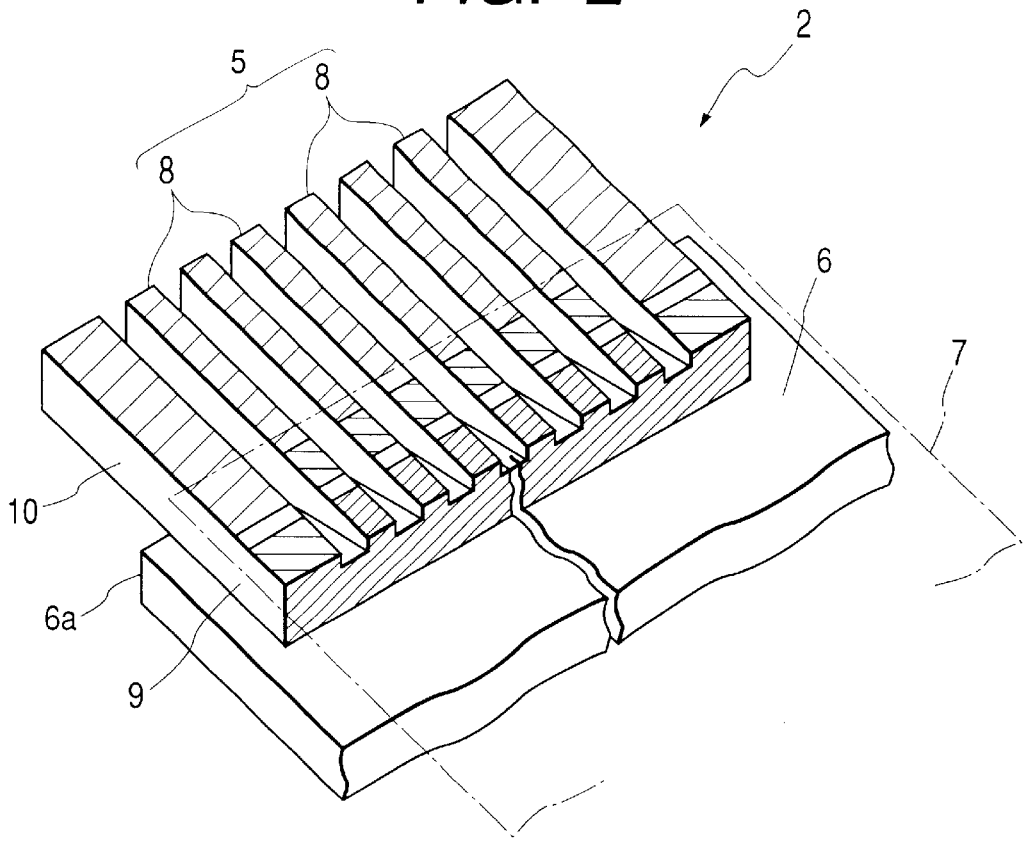
FIG. 2 is a perspective view of the vibrator unit.

First, the vibrator unit 2 will be described. As shown in FIG. 2, the vibrator unit 2 comprises a piezoelectric vibrator row 5, a fixation base 6 and a flexible cable 7. The vibrator 2 is a member formed by joining these members into a single unit. The piezoelectric vibrator row 5 comprises a plurality of piezoelectric vibrators 8. The piezoelectric vibrators 8 have a comb-like shape, and are cut into an extremely small width of, for example, approximately 30 to 100 $\mu$m. The free ends 10 of the piezoelectric vibrators 8 protrude outside the distal end face 6*a* of the fixation base 6 by joining the fixed ends 9 of the piezoelectric vibrators 8 onto the fixation base 6. That is, the piezoelectric vibrators 8 are supported on the fixation base 6 in the cantilevered manner. The flexible cable 7 is electrically connected to the piezoelectric vibrators 8 on the side face of the fixed ends 9 opposite to the fixation base 6. The fixation base 6 supporting the piezoelectric vibrators 8 is made of a plate-shaped member having a rigidity capable of receiving a reactive force from the piezoelectric vibrators 8. Preferably, the fixation base 6 is made of a metal plate. In the present embodiment, the fixation base 6 is made of a stainless steel plate with a thickness of approximately 1 mm. The piezoelectric vibrators 8 are joined to the distal end part of the fixation base 6.

Figure 3:
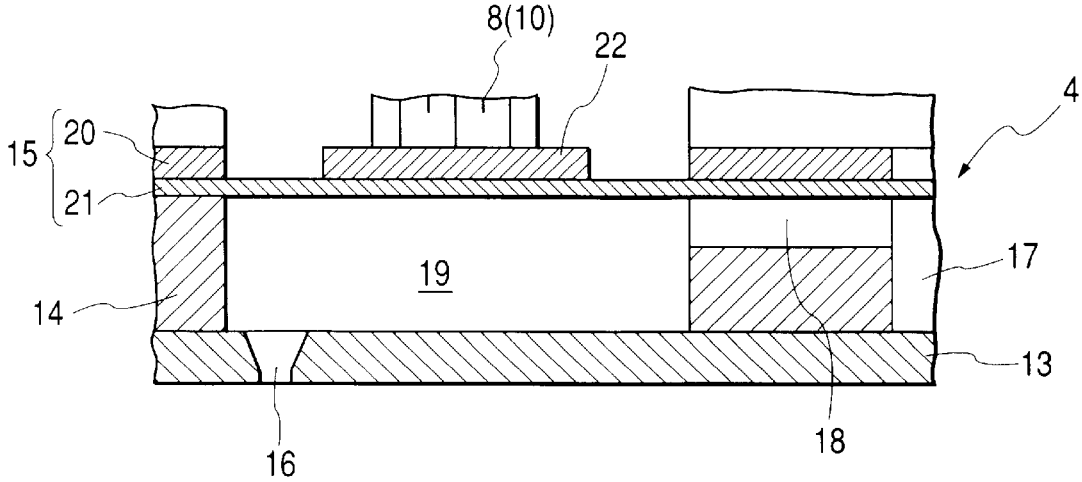
FIG. 3 is an enlarged cross-sectional view showing the part of a channel unit.

Next, the channel unit 4 will be described. As shown in FIG. 3, the channel unit 4 comprises a nozzle plate 13, a channel forming substrate 14 and an elastic plate 15. To form the channel unit 4, the nozzle plate 13 and the elastic plate 15 are laminated so that the plate 13 is disposed on one face of the channel forming substrate 14 and the plate 15 is disposed on the other face of the channel forming substrate 14 opposite to the nozzle plate 13, and these members are integrated by bonding or the like.

The nozzle plate 13 is a thin stainless steel plate where a plurality of nozzle orifices 16 are formed in rows with a pitch corresponding to the dot formation density. In the present embodiment, for example, 180 nozzle orifices 16 are formed in rows, and nozzle rows are formed by these nozzle orifices 16. Two nozzle rows are disposed side by side.

The channel forming substrate 14 is a plate-shaped member comprising a common ink reservoir 17 (only a part thereof is shown in the figure), an ink supply port 18 and a pressure chamber 19 and in which an ink channel is formed. The pressure chamber 19 is formed as a chamber elongated in a direction perpendicular to the direction of the rows of the nozzle orifices 16. The ink supply port 18 is formed as a narrowed part of the ink channel communicating the pressure chamber 19 and the common ink reservoir 17. The common ink reservoir 17 is for supplying ink in an ink cartridge (not shown) to each pressure chamber 19.

The elastic plate 15 is a composite plate member having a double structure where a resin film 21 of polyphenylene sulfide (PPS) or the like is laminated on a supporting plate 20 made of a metal such as stainless steel. The elastic plate 15 serves as a diaphragm portion that seals one opening of the pressure chamber 19 and as a compliance portion that seals one opening of the common ink reservoir 17. The part serving as the diaphragm portion is circularly removed by etching or the like to form an island part 22 for joining the distal ends of the free ends 10 of the piezoelectric vibrators 8. For the part serving as the compliance portion, the part of the supporting plate 20 is removed by etching or the like so that only the resin film 21 is left.

Figure 4:
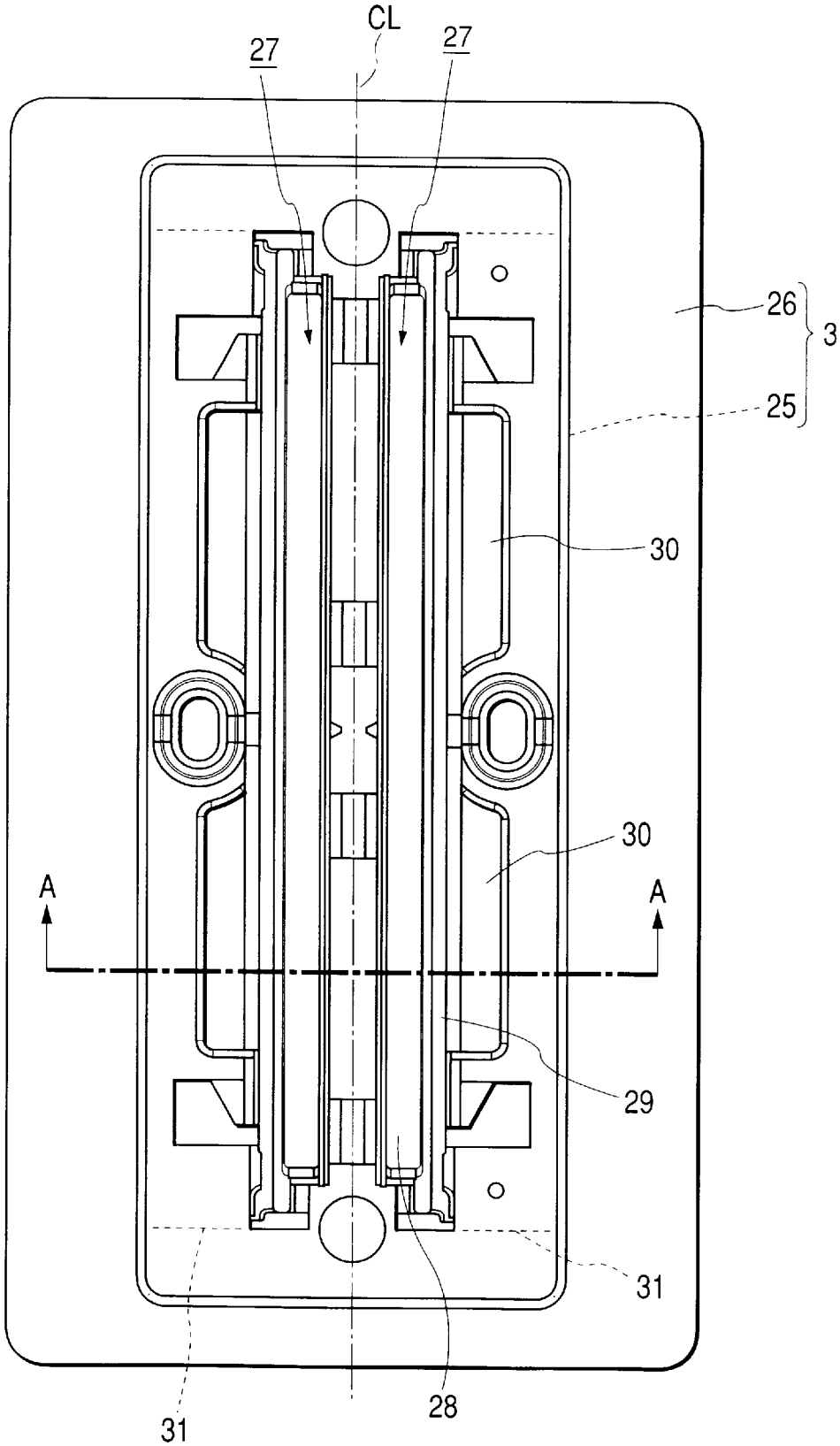
FIG. 4 is a plan view of a case viewed from the proximal end side.
Figure 5:
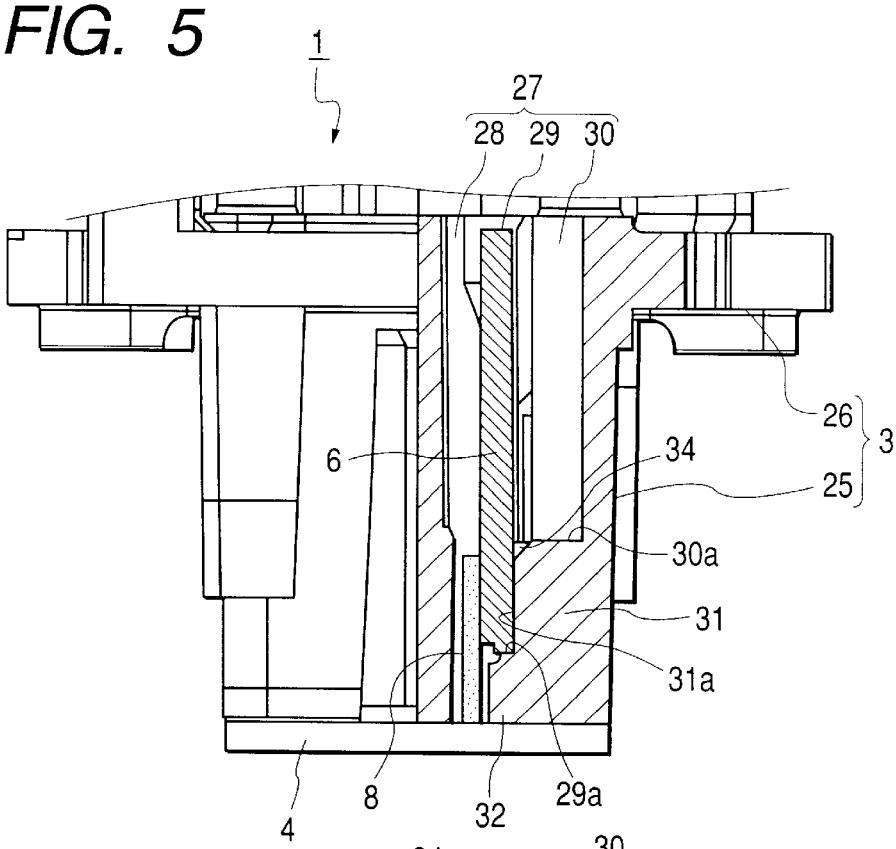
FIG. 5 is a partial cross section view taken on the line A—A of FIG. 4.

Next, the case 3 will be described. FIG. 4 is a plan view showing the case 3 viewed from the proximal end side (that is, the attachment face side). FIG. 5 is a view showing the partial cross section taken on the line A—A of FIG. 4. FIG. 4 shows a state of the case 3 with no vibrator unit 2 housed therein. FIG. 5 shows a state of the case with the vibrator unit 2 housed therein.

The case 3 comprises a block-shaped main body 25 and a flange 26 extending sideward from the proximal end of the main body 25. The case 3 is molded of a resin such as epoxy resin. The proximal end face of the case 3, that is, the attachment face on the side of the flange 26 is substantially rectangular when viewed from the proximal end side. In the case 3, a housing space 27 capable of housing the vibrator unit 2 is formed. The housing space 27 is formed as a through hole passing through the case 3 from the distal end face (the face on the side of the channel unit 4) to the attachment face. The housing space 27 is provided for each vibrator unit 2. For example, in the recording head 1 of the present embodiment, since two nozzle rows are provided and one vibrator unit 2 is provided for each nozzle row, two housing spaces 27 are disposed side by side. That is, one housing space 27 is disposed in each of positions that are symmetrical with respect to a central line CL in the direction of the shorter side of the attachment face.

As shown in FIG. 5, the housing space 27 comprises: a first housing space 28 in which the piezoelectric vibrator row 5 is housed; a second housing space 29 in which the fixation base 6 is housed; a relief concave portion 30 partially forming a non-bonding area on the back face (the face opposite to the piezoelectric vibrators 8) of the inserted fixation base 6.

The first housing space 28 is a flat rectangular opening being elongated in the direction of the longer side of the attachment face of the case 3 and being short in the direction of the shorter side of the attachment face, and is formed so as to extend from the distal end face to the proximal end face of the case 3.

The second housing space 29 is also a rectangular opening being elongated in the direction of the longer side of the attachment face and being short in the direction of the shorter side of the attachment face. The second housing space 29 is formed in a direction away from the first housing space 28, that is, in a direction away from the central line CL so as to communicate with the first housing space 28. The wall of the second housing space 29 opposite to the first housing space 28 is a fixation base bonding face to which the back face of the fixation base 6 is bonded. Therefore, in the main body 25, the part situated outside the fixation base bonding face serves as a base bonding wall 31.

The long-side dimension of the second housing space 29 is slightly larger than the width of the fixation base 6. The short-side dimension of the second housing space 29 is slightly larger-than the thickness of the fixation base 6. Both long-side ends of the second housing space 29 protrude outside both ends of the first housing space 28. In other words, the long-side end portions of the second housing space 29 are formed as grooves on the inner face of the hollow part in the case 3.

The bottom face **29*a* of the second housing space 29 is disposed at a distance slightly shorter than the length of the free ends 10 of the piezoelectric vibrators 8 from the distal end of the case 3 toward the proximal end (that is, toward the attachment face). The second housing space 29 is formed so as to be continuous from the position of the bottom face 29*a* to the attachment face. Since the vibrator unit 2 is inserted from the side of the attachment face with the free ends 10 facing the distal end side, the bottom face 29*a* of the second housing space 29 is opposed to the distal end face 6*a* of the fixation base 6 under a state where the vibrator unit 2 is housed. Therefore, the bottom face 29*a* of the second housing space 29 is a bonding face on which the distal end face 6*a* of the fixation base 6** is bonded.

Since the bottom face **29*a* of the second housing space 29 and the distal end face 6*a* of the fixation base 6 are bonded so as to be opposite to each other as described above, in the case 3, the part situated on the distal end side of the second housing space 29 serves as a distal end face bonding portion 32. The distal end face bonding portion 32 can be said to be a protruding portion formed by protruding a distal end part of the base bonding wall 31 outside the bonding face on which the back face of the fixation base 6** is bonded.

Figure 6:
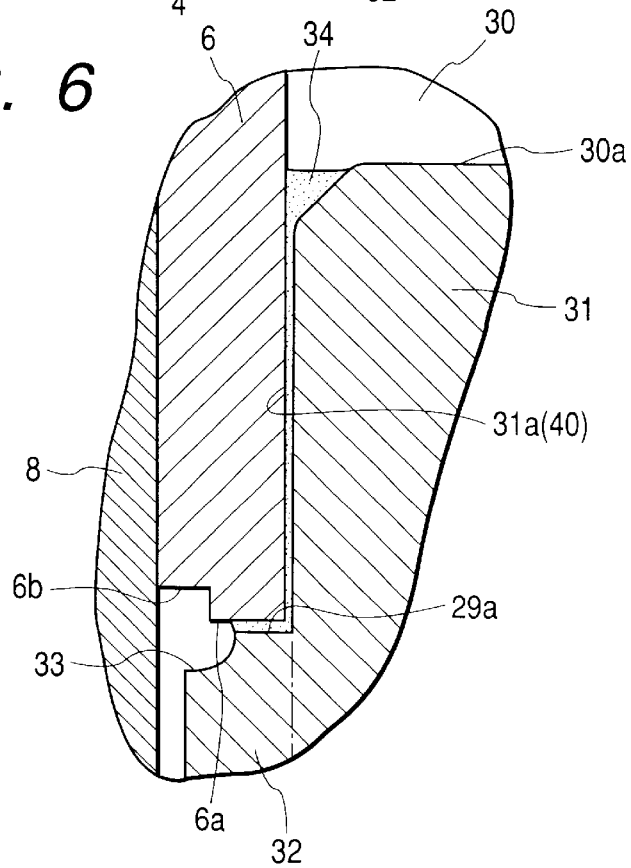
FIG. 6 is an enlarged cross-sectional view showing the part where a fixation base and the case are bonded together.

In the distal end face bonding portion 32, a recess is provided in a corner on the side facing the piezoelectric vibrator row 5. In the present embodiment, as shown in FIG. 6, a curved recess 33 having a circularly recessed configuration is provided in a corner of the distal end face bonding portion 32. By the curved recess 33, a distal end face bonding area formed as an area where the distal end face **6*a* of the fixation base 6 and the bottom face 29*a* meet is separated from the vibrators. This is done in order to prevent the adhesive for bonding the fixation base 6 and the base bonding wall 31 from adhering to the piezoelectric vibrators 8**.

That is, when the vibrator unit 2 is bonded in the housing space 27, as described later, the adhesive is filled into the gap between the bonding face of the fixation base 6 and the bonding face of the base bonding wall 31. However, since this adhesive is a fluid, there is a possibility that the adhesive passes through the gap between the bonding face of the distal end face bonding portion 32 and the distal end face **6*a* of the fixation base 6 to reach the piezoelectric vibrators 8. When the adhesive reaches the piezoelectric vibrators 8, the adhesive flows into the gaps between the adjoining piezoelectric vibrators 8, so that the piezoelectric vibrators 8 are bonded together by the influent adhesive. Consequently, the piezoelectric vibrators 8** do not operate normally.

When the curved recess 33 is provided in the corner of the distal end face bonding portion 32, the distal end face bonding area can be separated from the piezoelectric vibrators 8. When the adhesive reaches the edge of the curved recess 33, the advance of the adhesive can be stopped by surface tension. With this, the adhesive can be held within the distal end face bonding area, so that the problem where the adhesive reaches the piezoelectric vibrators 8 can be prevented.

While the curved recess 33 having a circularly curved face is provided in the present embodiment, the recess is not limited to the curved recess 33. For example, an angular recess may be provided.

Figure 7:
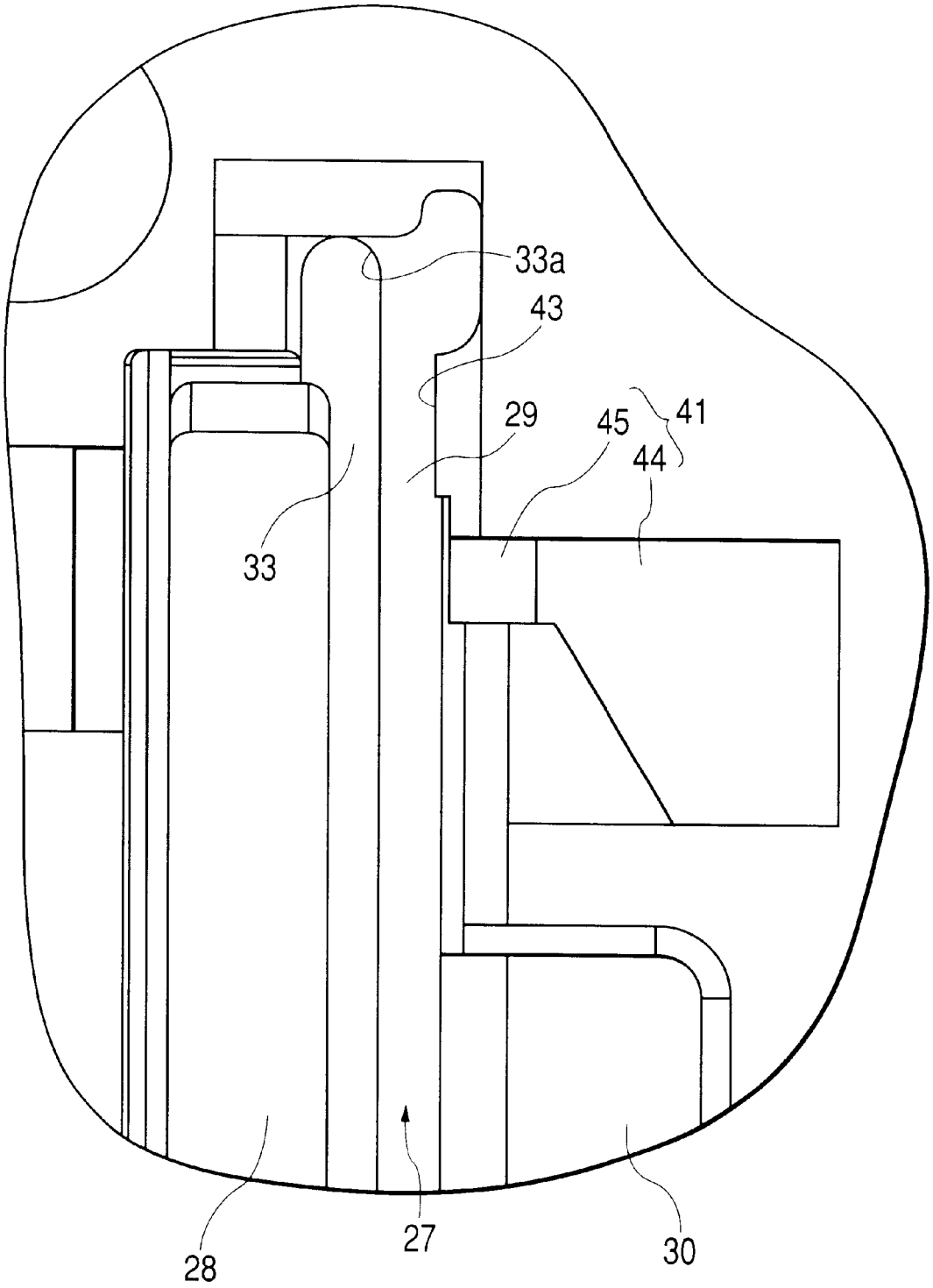
FIG. 7 is an enlarged view explaining an end of a curved recess.

In the present embodiment, as shown in FIG. 7, both ends 33*a*, in the longitudinal direction of the curved recess 33 (long-side direction of the housing space 27), are circularly curved faces that are substantially circularly recessed so that no angular parts are formed. According to this configuration, the problem wherein the adhesive flows around to reach the piezoelectric vibrators 8 can be prevented.

Moreover, in the present embodiment, an angular recess 6*b* is provided at the distal end of the fixation base 6. This angular recess 6*b* is formed by angularly recessing a corner on the side of the piezoelectric vibrators 8. The angular recess 6*b* is formed so as to define a corner portion with the distal end face 6*a* of the fixation base 6, situated closer to the piezoelectric vibrators 8 than the most-retracted portion of the curved recess 33, under a state where the vibrator unit is positioned.

Consequently, the adhesive can be held also by the corner portion and the curved recess 33. Therefore, even if the adhesive flows out from the distal end face bonding area, the flown-out adhesive can be held, so that the problem wherein the adhesive reaches the piezoelectric vibrators 8 can reliably be prevented.

The relief concave portion 30 is a rectangular opening being elongated in the direction of the longer side of the attachment face of the case 3 and being short in the direction of the shorter side of the attachment face, and is formed so as to be continuous from the neighborhood of the midpoint, in the height direction, of the case 3 to the attachment face.

The relief concave portion 30 is formed outside the second housing space 29 so as to communicate with the second housing space 29. In other words, the relief concave portion 30 is formed by recessing or retracting an area of the base bonding wall 31 on the proximal end side of the case 3 (that is, an area substantially from the midpoint in the height direction of the case 3 to the attachment face) so as to be concaved in the thickness direction of the fixation base 6. In the present embodiment, the relief concave portions 30 are concaved by 1.8 mm from the back face of the fixation base 6.

By the relief concave portion 30, an area (non-bonding area) separate from the back face of the fixation base 6 is formed in the base bonding wall 31. Therefore, the part excepting the non-bonding area is the bonding face 31*a* of the base bonding wall 31.

Moreover, as shown in FIG. 6, a visual confirming portion 34 for visually confirming the state of filling of the adhesive in a bonding area 40 from outside the case 3 is provided at the boundary between the relief concave portion 30 and the bonding area 40, specifically, at the boundary between the bottom face 30*a* of the relief concave portion 30 and the bonding face 31*a* of the base bonding wall 31. The visual confirming portion 34 is formed by tapering the boundary between the relief concave portion 30 and the bonding area 40 so that the opening becomes wider toward the relief concave portion 30. By the visual confirming portion 34, the area of the free face of the adhesive substantially flush with the bottom face 30*a* of the relief concave portion 30 can be increased, so that the filling state of the adhesive can easily be confirmed through the relief concave portion 30.

Figure 8:
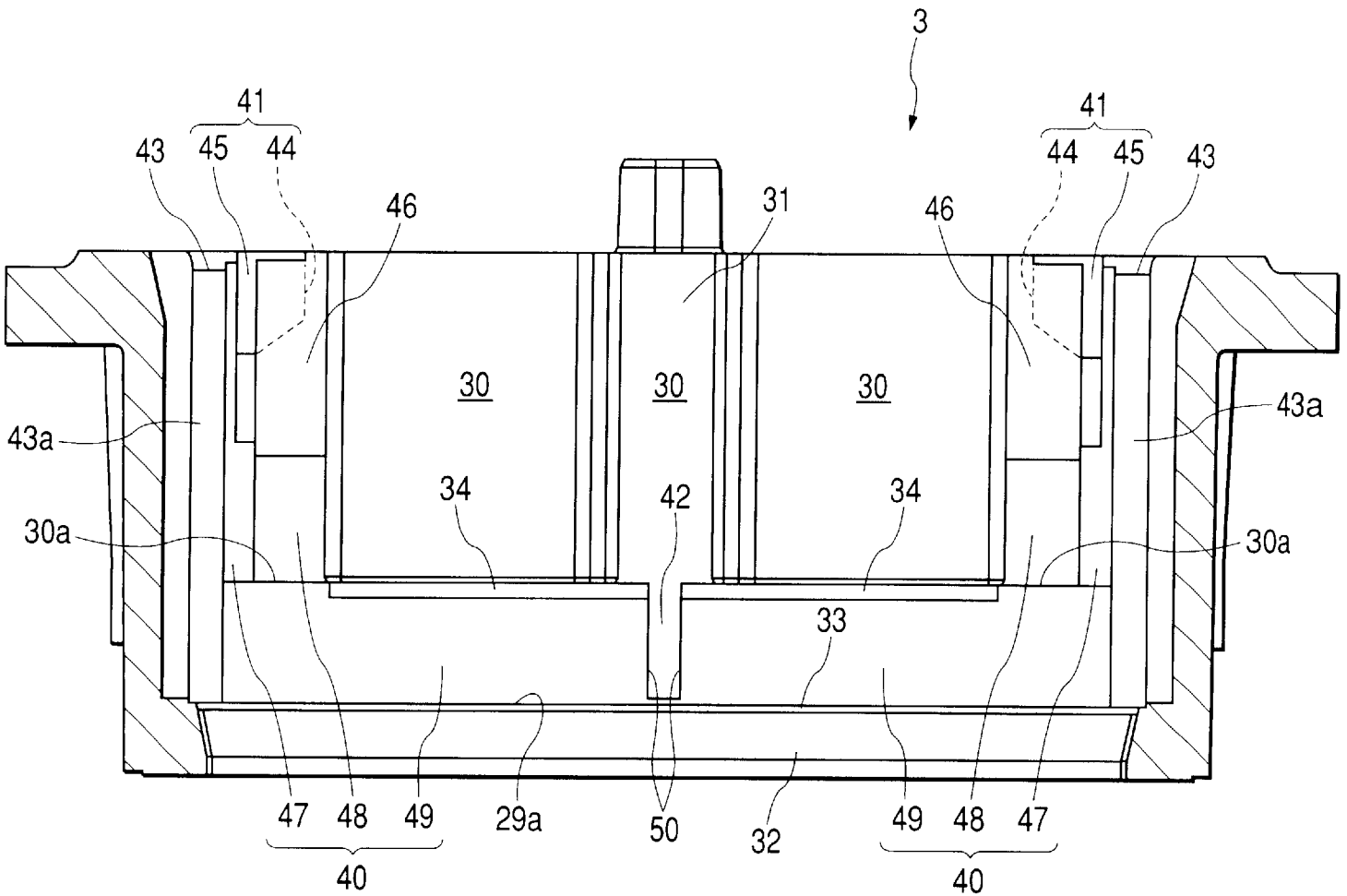
FIG. 8 is a view explaining the structure of a base bonding wall of the case according to a first embodiment of the invention.
Figure 9:
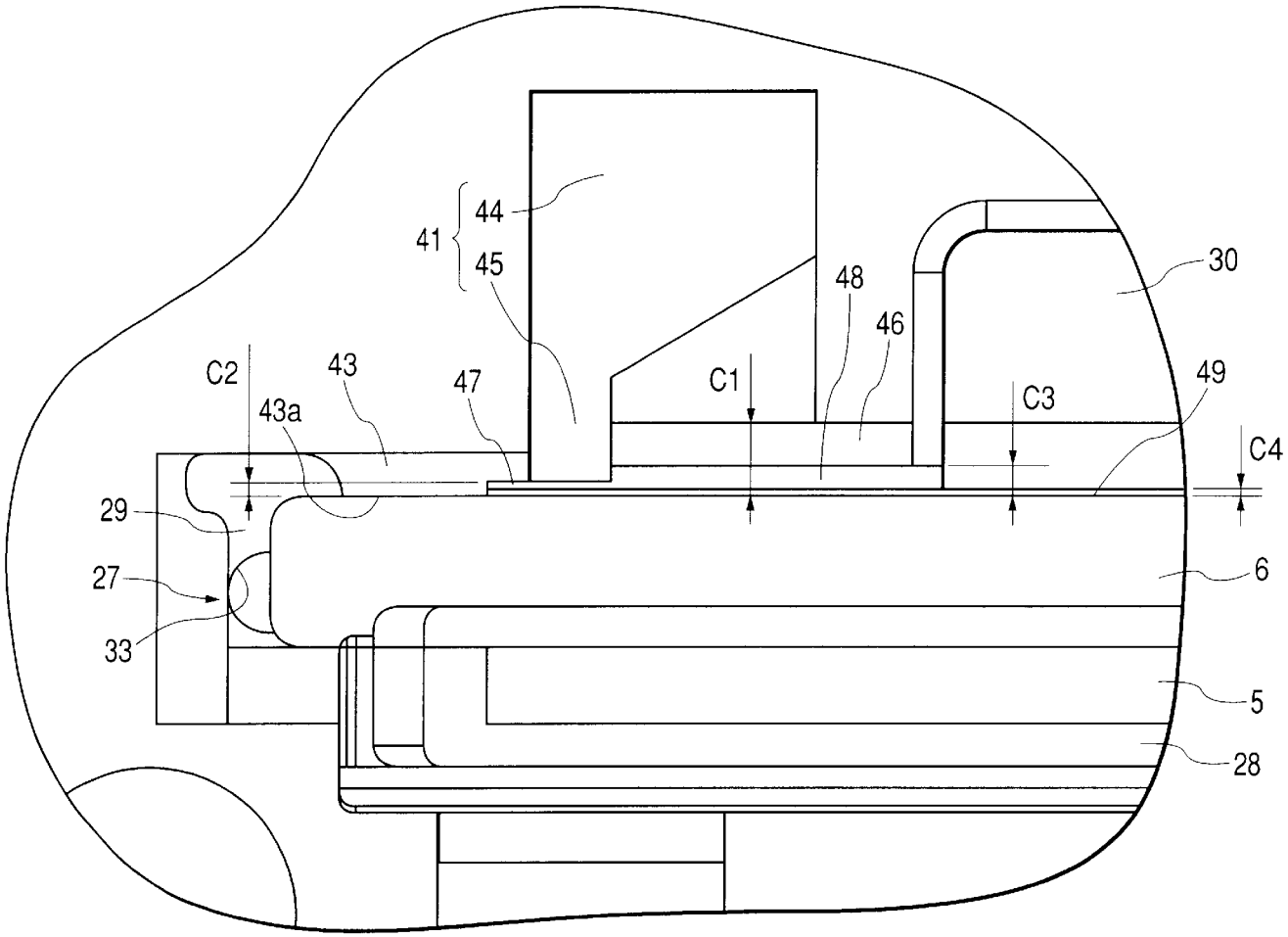
FIG. 9 is an enlargement view of an adhesive inlet and its vicinities.

Next, the structure of bonding of the base bonding wall 31 and the fixation base 6 will be described. FIG. 8 is a cross-sectional view explaining the structure of the base bonding wall 31 of the case 3. FIG. 9 is an enlarged view, viewed from the side of the attachment face of the case 3, of a state where the vibrator unit 2 is housed in the housing space 27.

In the base bonding wall 31 of the case 3, adhesive inlets 41 and an air outlet 42 are disposed so as to face the bonding areas 40 of the fixation base 6 and the base bonding wall 31. The adhesive inlets 41 are grooves in which the adhesive for bonding the vibrator unit 2 in the housing space 27 is poured. The air outlet 42 is a groove for discharging air pushed out as the adhesive is filled. In addition to these, the above-described relief concave portions 30 (non-bonding areas) are also provided in the base bonding wall 31.

In the present embodiment, a pair of adhesive inlets 41 are disposed so as to face the longitudinal side edges of the bonding areas 40, and the air outlet 42 is situated between the adhesive inlets 41. The distance between the bonding faces of the base bonding wall 31 and the fixation base 6 is set so that the poured adhesive is gradually filled from the side of the adhesive inlets 41 to the side of the air outlet 42 in the bonding areas 40 by a capillary force.

That is, the bonding areas 40 are defined by the relief concave portions 30 and positioning ribs 43 for defining the position of the fixation base 6. The positioning ribs 43 are protrusions provided with reference faces 43*a* that are in close contact with the back face of the fixation base 6 without clearances. The positioning ribs 43 of the present embodiment are disposed so that the distal ends thereof are flush with the bottom face 29*a* of the second housing space 29, and are formed so as to be continuous from this position toward the attachment face of the case 3. That is, the positioning ribs 43 are formed so as to extend in the height direction of the case 3, in other words, in the height direction of the bonding areas 40.

As shown in FIG. 8, the bonding areas 40 are formed so as to have a substantially U-shaped cross section. The air outlet 42 is disposed in the lower part of the U-shape and substantially at the center in the lateral direction.

The adhesive inlets 41 are adjoiningly disposed at inner portions of the proximal ends (that is, the parts on the side of the attachment face) of the positioning ribs 43. The adhesive inlets 41 each comprise an adhesive receiving portion 44 and a communication groove 45. The adhesive receiving portion 44 is a bottomed concave chamber opened at the attachment face of the case 3 for receiving the adhesive fed from an adhesive feeder (not shown). The communication groove 45 is elongated in the height direction of the case 3 so as to communicate the adhesive receiving portion 44 and the bonding area 40.

In the present embodiment, since the adhesive inlets 41 (the communication grooves 45) are disposed inside the pair of positioning ribs 43, the adhesive flowing from the adhesive pouring portions 41 into the bonding areas 40 is dammed because the reference faces 43*a* of the positioning ribs 43 are in close contact with the back face of the fixation base 6, and does not spread to outer sides of the positioning ribs 43. This reliably prevents problems caused by the adhesive leaking from the bonding areas 40, for example, a problem where the piezoelectric vibrators 8 are bonded together.

Moreover, in the present embodiment, adhesive reservoirs 46 communicating with the communication grooves 45 are provided. As shown in FIG. 9, the adhesive reservoirs 46 each comprise a space where the clearance C1 from the back face of the fixation base is 0.5 mm. The adhesive poured in the adhesive inlets 41 is directed into the adhesive reservoirs 46 to be temporarily held therein. The adhesive reservoirs 46 are provided with a capacity capable of holding a necessary amount of adhesive for filling up the bonding areas 40.

The bonding areas 40 each comprise: a first bonding area 47 disposed so as to adjoin the distal end side of the communication groove 45; a second bonding area 48 disposed so as to adjoin the distal end side of the adhesive-reservoir 46; and a third bonding area 49 disposed in an area that is on the distal end side of the first bonding area 47 and the second bonding area 48 and corresponds to the distal end side area of the fixation base 6.

The first bonding areas 47 are strip-like areas elongated in the height direction of the case 3. The distal ends thereof are flush with the bottom faces 30*a* of the relief concave portions 30, and the proximal ends thereof are situated in the vicinity of the attachment face of the case 3. The lateral outer edges of the first bonding areas 47 are in contact with the positioning ribs 43. The upper parts of the lateral inner edges of the first bonding areas 47 connect with the adhesive inlets 41, and the lower parts thereof connect with the second bonding areas 48. The first bonding areas 47 each comprise a face where the clearance C2 from the back face of the fixation base is 0.1 mm. Therefore, the influent adhesive moves in the first bonding area 47 by a capillary force to fill it up.

The second bonding areas 48 are substantially rectangular areas slightly elongated in the height direction of the case 3. The distal ends thereof are flush with the bottom faces 30*a* of the relief concave portions 30, and the proximal ends thereof connect with the distal ends of the adhesive reservoirs 46. The lateral outer edges of the second bonding areas 48 connect with the first bonding areas 47, and the lateral inner edges thereof connect with the relief concave portions 30. The second bonding areas 48 each comprise a face where the clearance C3 from the back face of the fixation base is 0.2 mm. Therefore, also in the second bonding area 48, the influent adhesive moves in the second bonding area 48 by a capillary force to fill it up.

Comparing the clearance, from the fixation base 6, of the first bonding areas 47 with that of the second bonding areas 48, the clearance C2 of the first bonding areas 47 is narrower than the clearance C3 of the second bonding areas 48. Therefore, the capillary force of the adhesive in the first bonding areas 47 is stronger than that of the second bonding areas 48. Consequently, the adhesive flowing in the first bonding areas 47 moves faster than that flowing in the second bonding areas 48.

The third bonding areas 49 are substantially rectangular areas elongated in the horizontal direction (that is, the direction in which the vibrators are arranged). The edges thereof on the side of the relief concave portions 30 connect with the first bonding areas 47 and the second bonding areas 48 on the lateral outer sides, and the remaining parts connect with the visual confirming portions 34. The edges thereof on the side of the distal end face bonding portion 32 are flush with the bottom face 29*a* of the second housing space 29. The lateral outer edges of the third bonding areas 49 are in contact with the positioning ribs 43, and the lateral inner edges thereof connect with the air outlet 42. The third bonding areas 49 each comprise a face where the clearance C4 from the back face of the fixation base is 0.05 mm. Therefore, also in the third bonding areas 49, the influent adhesive fills up the third bonding areas 49 by a capillary force.

Since the clearance C4 of the third bonding areas 49 is narrower than the clearances C2 and C3 of the first bonding areas 47 and the second bonding areas 48, the capillary force of the adhesive in the third bonding areas 49 is stronger than the capillary forces of the adhesives in the first bonding areas 47 and the second bonding areas 48. In summary, in the bonding areas 40, the distance from the bonding face of the base bonding wall 31 to the bonding face of the fixation base 6 is narrowed stepwise from the adhesive inlets 41 toward the air outlet 42 so that the capillary force of the adhesive increases with distance from the adhesive inlets 41. Consequently, the adhesive poured in the adhesive inlets 41 can reliably be directed to the air outlet 42.

The air outlet 42 is a groove elongated in the height direction of the main body 25. The proximal end of the air outlet 42 connects with the relief concave portions 30. The air outlet 42 is recessed more largely than the third bonding areas 49. In the present embodiment, it recedes 0.5 mm from the back face of the fixation base 6. Therefore, when the fixation base 6 is housed and positioned, a 0.05-mm-wide slit corresponding to the clearance C4 of the third bonding areas 49 is formed at the boundary between the air outlet 42 and the third bonding areas 49, and the slit serves as a vent portion 50. The gap of the vent portion 50, that is, the width of the slit is such that the adhesive filling up the third bonding areas 49 is held by surface tension. This prevents the problem wherein the adhesive in the bonding areas 40 flows into the air outlet 42.

Next, the procedure for housing and bonding the vibrator unit 2 in the housing space 27 will be described.

In this case, first, the vibrator unit 2 is housed in the housing space 27 and positioned. That is, the adhesive is thinly applied to the distal end faces of the piezoelectric vibrators 8, the fixation base 6 is held by a jig, and the vibrator unit 2 is inserted into the housing space 27 with the free ends 10 at the front. Then, the vibrator unit 2 is positioned with the distal end faces of the free ends 10 abutting the faces of the corresponding island parts 22.

Figure 10:
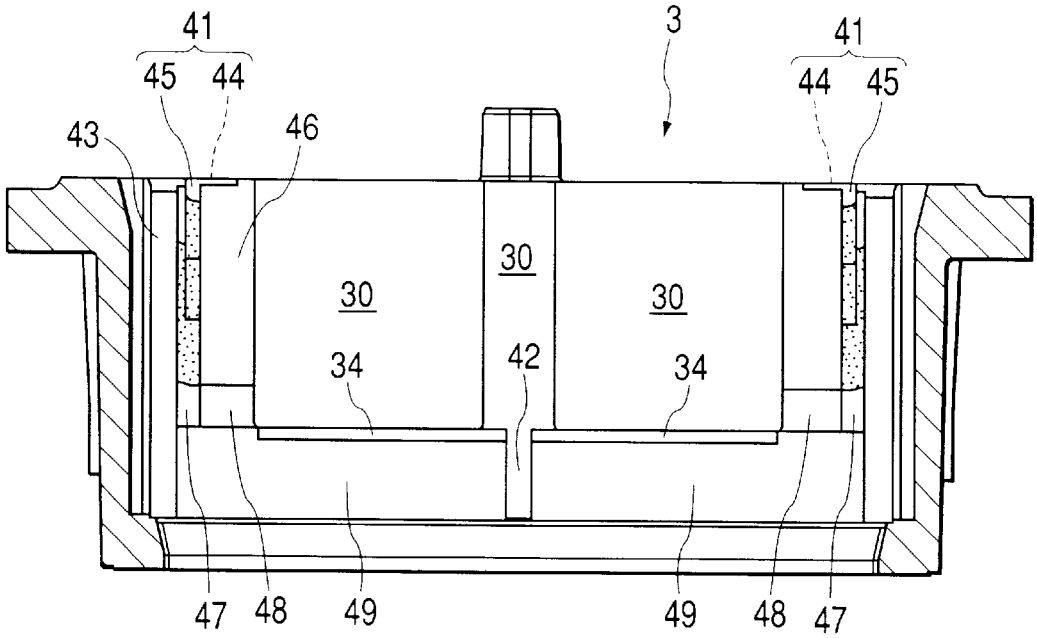
FIG. 10 is a view explaining the state when the adhesive is poured.

After the vibrator unit 2 is positioned, the nozzle of the adhesive feeder is faced toward the adhesive receiving portions 44 of the adhesive inlets 41, and the adhesive is poured into the adhesive receiving portions 44 (the state of FIG. 10). When the adhesive is poured, the case 3 is set with the side of the adhesive receiving portions 44 upward. The poured adhesive flows from the adhesive receiving portions 44 through the communication grooves 45, and a part thereof flows into the first bonding areas 47 and the second bonding areas 48 little by little. Before flowing into the bonding areas 40, the adhesive is temporarily held in the adhesive receiving portions 44 and the adhesive reservoirs 46. Since the adhesive reservoirs 46 are provided, it can be made difficult for the adhesive to flow out from the proximal end side opening even if the adhesive pouring speed is increased. This reduces the time necessary for the bonding step. Further, since the adhesive reservoirs 46 are provided with a capacity capable of holding a necessary amount of adhesive for filling up the bonding areas 40, it is necessary to pour the adhesive only once. Consequently, the time necessary for the bonding step can be further reduced.

Figure 11:
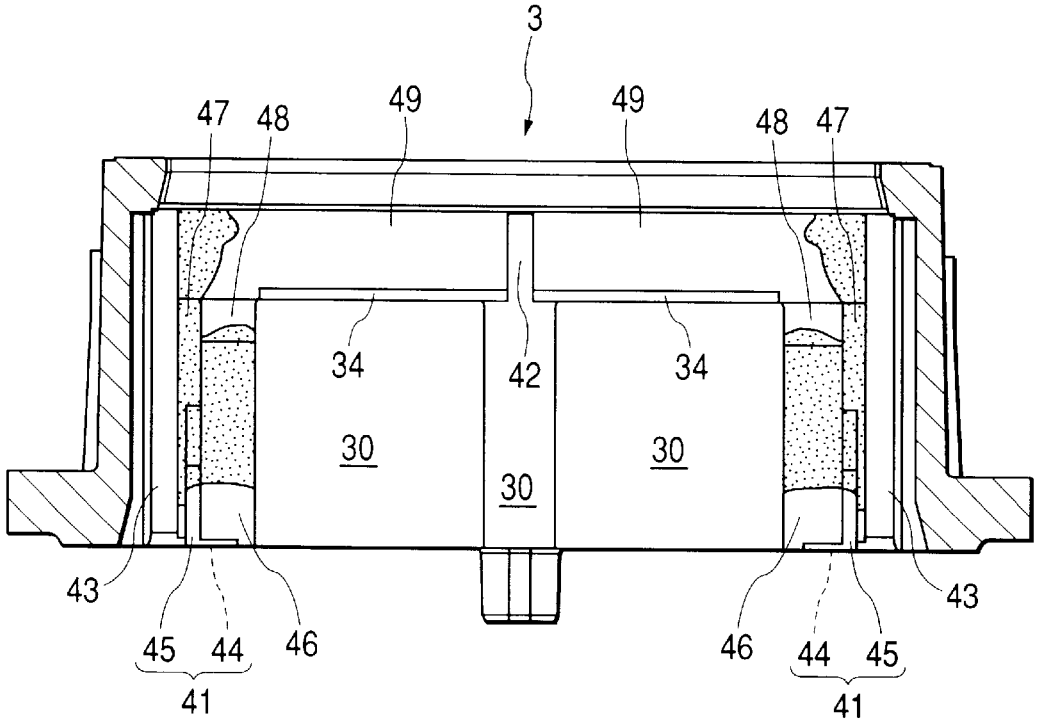
FIG. 11 is a view explaining how the poured adhesive moves up by a capillary force.

After the pouring of the adhesive is finished, the case 3 is turned upside down. That is, the case 3 is turned so that the side of the adhesive receiving portions 44 is at the bottom (the state of FIG. 11). This is done in order to fill the adhesive in the bonding areas 40 by a capillary force without gravity acting. At this time, as mentioned above, the capillary force of the adhesive in the first bonding areas 47 is stronger than that of the adhesive in the second bonding areas 48. Therefore, the adhesive moves faster in the first bonding areas 47 than in the second bonding areas 48. Since the first bonding areas 47 communicate with the third bonding areas 49 at the lateral outer ends, the adhesive is gradually filled from the outer ends of the third bonding areas 49. As the adhesive is filled, the air in the bonding areas 40 is discharged into the air outlet 42. In other words, by the difference in capillary force, the adhesive is gradually filled from the ends of the bonding areas 40 while air is expelled.

Figure 12:
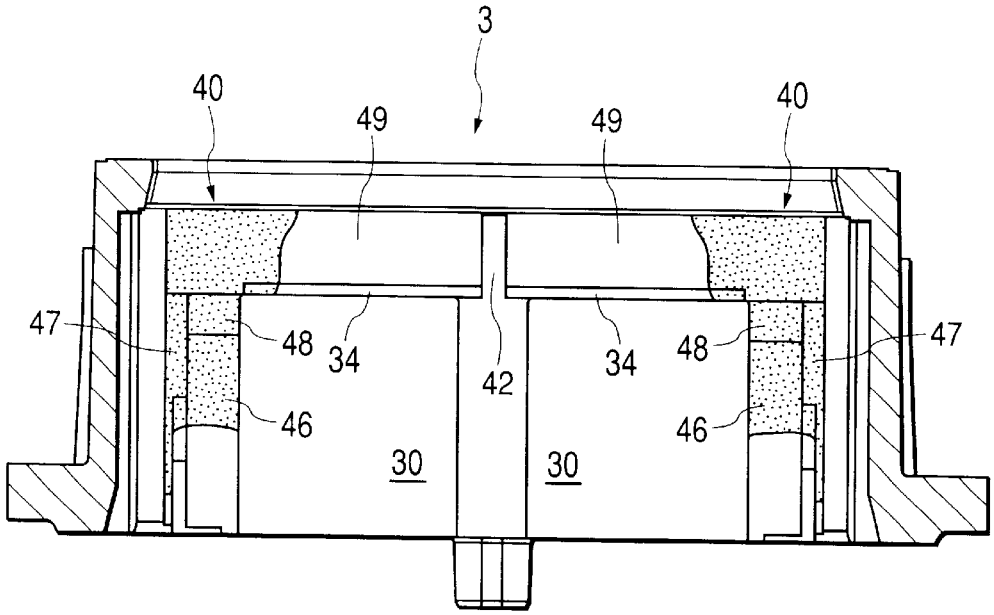
FIG. 12 is a view explaining how the adhesive is filled in third bonding areas by the capillary force.

Then, the adhesive in the second bonding areas 48 reaches the inside of the third bonding areas 49 and flows into the third bonding areas 49 (the state of FIG. 12). At this time, since the lateral outer ends in the third bonding areas 49 are already filled with the adhesive flowing from the first bonding areas 47, it can be prevented that bubbles from remaining thereat due to flow-in of the adhesive from the second bonding areas 48.

Figure 13:
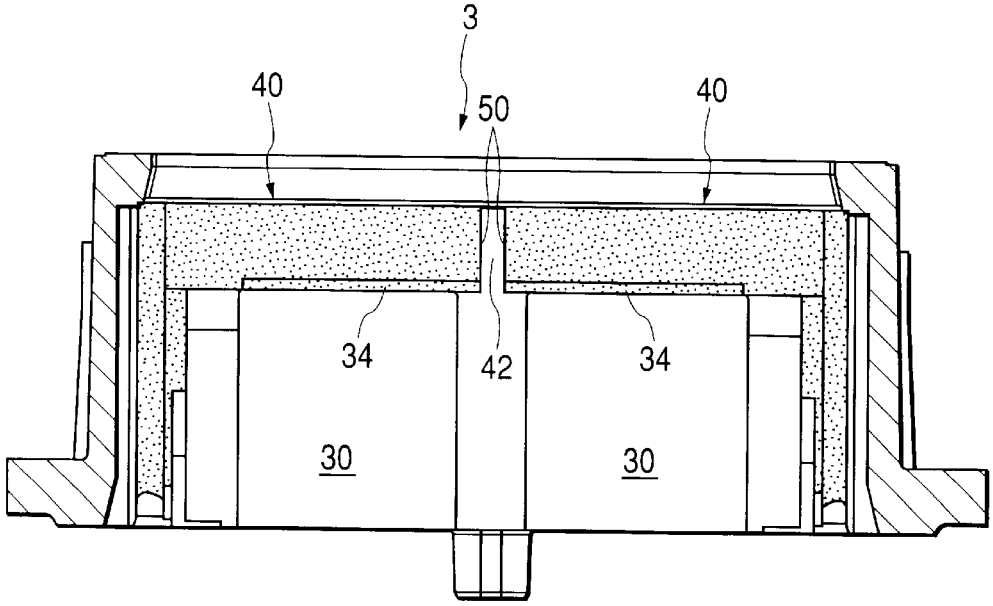
FIG. 13 is a view explaining the state where the third bonding areas are filled with the adhesive.

Thereafter, the adhesive gradually moves toward the air outlet 42 by the capillary force in the third bonding areas 49 and fills the entire bonding areas 40 while expelling air (the state of FIG. 13). Since the adhesive at the boundary between the third bonding areas 49 and the air outlet 42 is held in the vent portion 50 by surface tension, the problem wherein the adhesive flows out toward the air outlet 42 side can be prevented.

In the present embodiment, since the visual confirming portions 34 are provided, whether the adhesive is filled in the entire bonding areas 40 or not can be determined by visually confirming the filling state of the adhesive in the visual confirming portions 34. Consequently, problems such as poor bonding can reliably be prevented.

After the bonding areas 40 are filled with the adhesive, the adhesive in the bonding areas 40 and the adhesive at the distal ends of the free ends 10 are cured. For example, the adhesives are left for an appropriate time while heated to a predetermined temperature. Consequently, the fixation base 6 and the case inner wall (the base bonding wall 31) are bonded together, and the distal ends of the free ends 10 are bonded to the island parts 22.

As described above, in the present embodiment, since the clearances of the bonding areas 47, 48 and 49 are set so that the adhesive poured in the adhesive inlets 41 are filled in the bonding areas 40 from the side of the adhesive inlets 41 to the side of the air outlet 42 by the capillary force, the influent adhesive is gradually filled in the bonding areas 40 from the side of the adhesive inlets 41. With this arrangement, the adhesive can be filled while the air in the bonding areas 40 is expelled toward the air outlet 42 side. Therefore, it can be prevented that bubbles remain in the bonding areas 40 of the fixation base 6 and the base bonding wall 31. Consequently, partial lack of rigidity in the bonding areas 40 can be prevented, so that the behaviors of the piezoelectric vibrators 8 can be made the same. As a result, ink drop jetting characteristics such as the flying speed and the ink amount can be stabilized.

Figure 14:
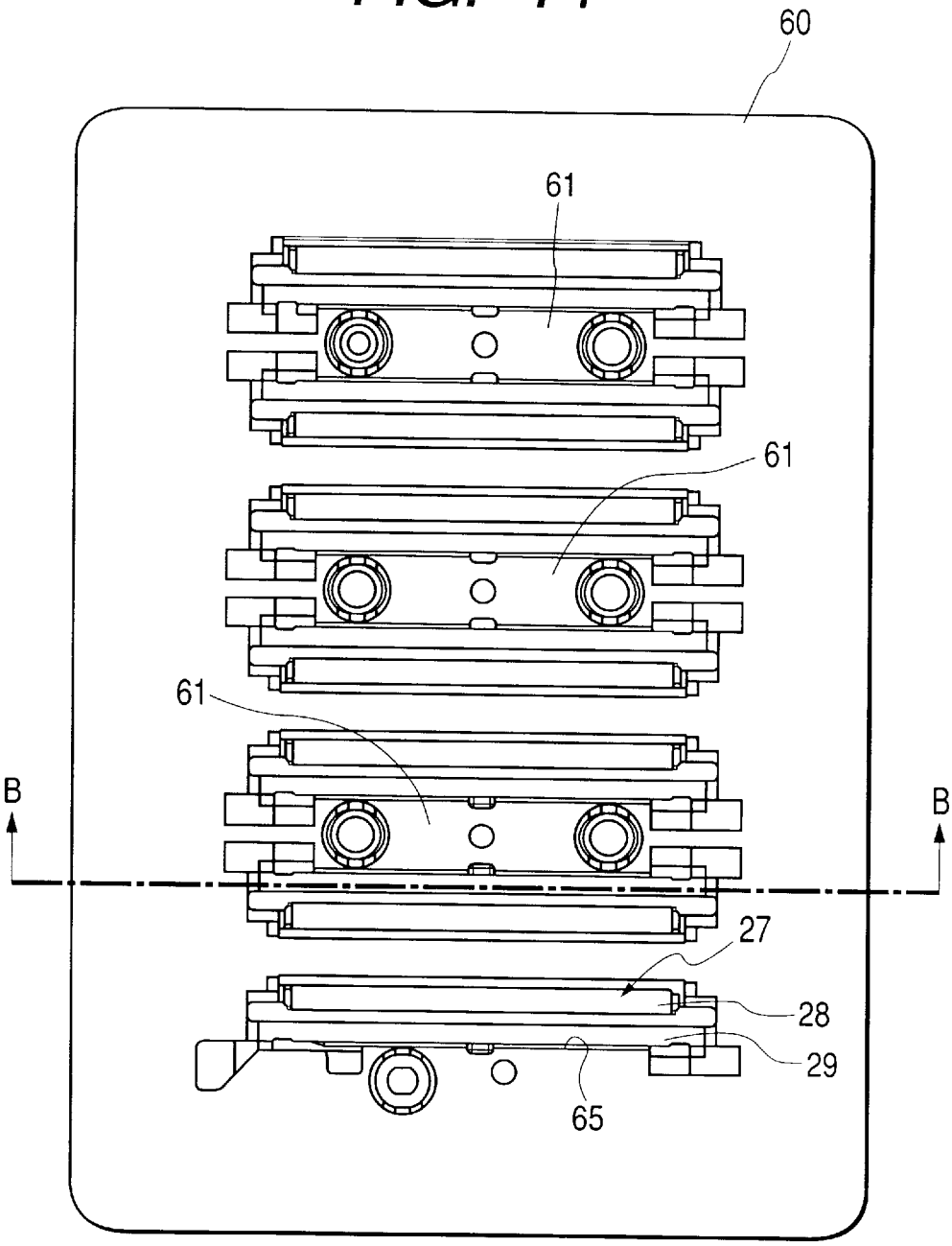
FIG. 14 is a plan view of a case according to a second embodiment of the invention.

While in the first embodiment, the recording head 1 in which two vibrator units 2 where the piezoelectric vibrators 8 are arranged along the length of the attachment face of the case 3 are housed so as to face each other is shown as an example, the present invention is not limited to this structure. For example, the present invention is also applicable to a recording head of a structure such that, using a case 60 shown in FIG. 14, a plurality of vibrator units 2 are arranged along the length of the attachment face of the case 60. Hereinafter, this recording head will be described. In the description given below, the same portions as those of the first embodiment are designated by the same reference numbers and are not described.

Figure 15:
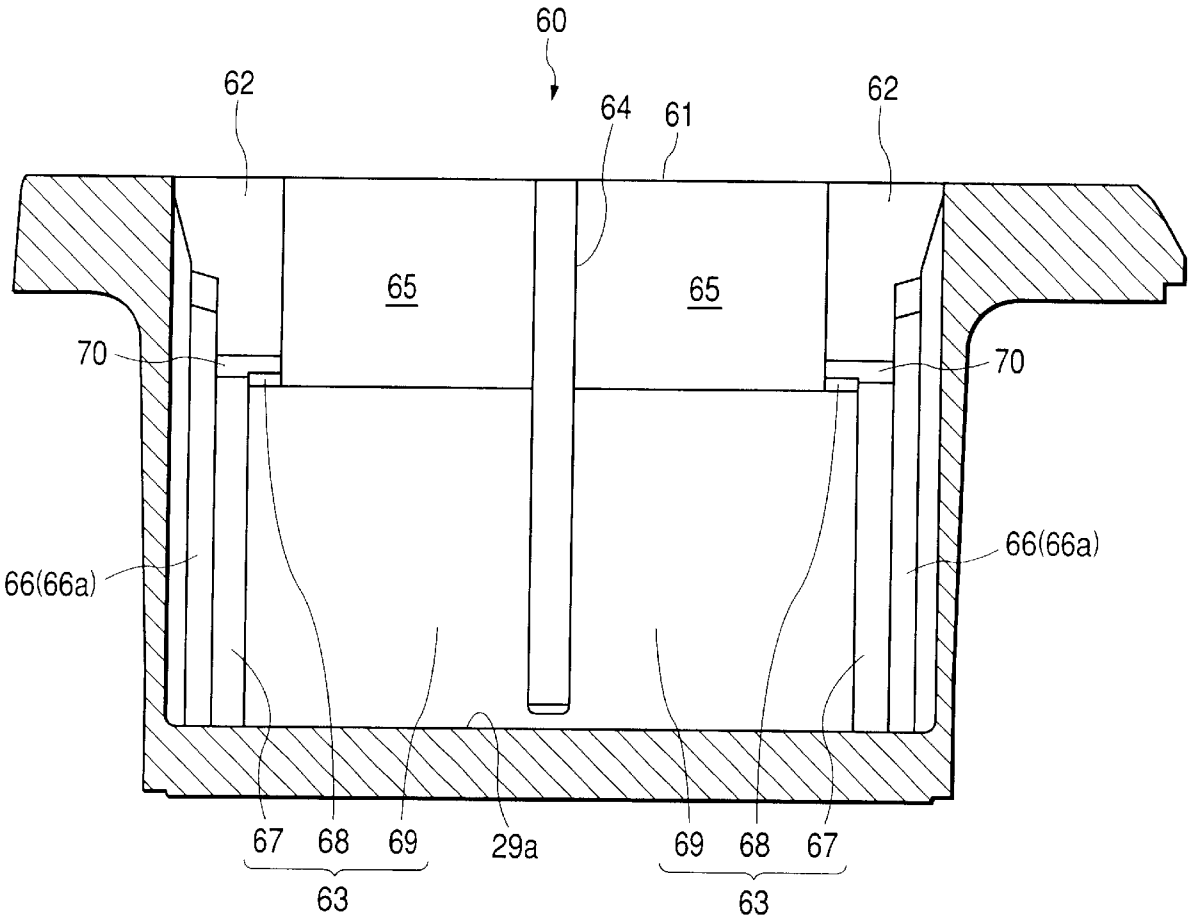
FIG. 15 is a cross-sectional view taken on the line B—B of FIG. 14.

As shown in FIG. 15, also in this second embodiment, a base bonding wall 61 of the case 60 is provided with adhesive inlets 62, bonding areas 63, an air outlet 64 and relief concave portions 65. The adhesive inlets 62 are disposed so as to face the lateral side edges of the bonding areas 63. The air outlet 64 is disposed between the adhesive inlets 62, specifically, substantially at the center, in the horizontal direction, of the bonding areas 63. Positioning ribs 66 are formed so as to extend in the height direction of the case 60 (that is, in the height direction of the bonding areas 63) and to adjoin the lateral side edges of the bonding areas 63. The positioning ribs 66 are also protrusions for positioning the fixation base 6, and the faces thereof facing the back face of the fixation base 6 serve as reference faces 66*a*.

The distance from the bonding face of the base bonding wall 61 to the bonding face of the fixation base 6 in the bonding areas 63 is set so that the adhesive poured in the adhesive inlets 62 is filled in the bonding areas 63 from the side of the adhesive inlets 62 to the side of the air outlet 64 by a capillary force.

The adhesive inlets 62 are disposed in positions at the proximal end (the part on the side of the attachment face) of the case 60 whose positions are between the positioning ribs 66. Also in the present embodiment, since the reference faces 66*a* of the positioning ribs 66 are in close contact with the back face of the fixation base 6, the adhesive poured from the adhesive inlets 62 is dammed, so that the problem wherein the adhesive flows out over the positioning ribs 66 can be prevented.

The adhesive inlets 62 each comprise, for example, a recess where the clearance from the back face of the fixation base is 1.3 mm, and serve also as adhesive reservoirs. That is, the adhesive inlets 62 are provided with a capacity capable of holding a necessary amount of adhesive for filling up the bonding areas 63. Rectangular relief concave portions 65 are disposed on the lateral inner sides of the adhesive inlets 62. The relief concave portions 65 each comprise a recess where the clearance from the back face of the fixation base is 1.0 mm.

The bonding areas 63 each comprise: a first bonding area 67 disposed on the distal end side of the adhesive inlet 62; a second bonding area 68 disposed so as to adjoin the right or left inner side of the first bonding area 67; and a third bonding area 69 whose right or left outer side adjoins the first bonding area 67 and whose right or left inner side adjoins the air outlet 64. Tapered portions 70 inclined toward the first bonding areas 67 and the second bonding areas 68 are disposed between the adhesive inlets 62 and the first bonding areas 67 and between the adhesive inlets 62 and the second bonding areas 68. The adhesive inlets 62 and the first bonding areas 67 and the second bonding areas 68 are connected through the tapered portions 70.

The first bonding areas 67 are strip-like areas elongated in the height direction of the case 60. The distal ends thereof are substantially flush with the bottom face 29*a* the second housing space 29 to which the distal end face 6*a* of the fixation base 6 is bonded, and the proximal ends thereof adjoin the tapered portions 70. The lateral outer edges of the first bonding areas 67 are in contact with the positioning ribs 66, and the lateral inner edges thereof connect with the third bonding areas 69. The first bonding areas 67 each comprise a face where the clearance from the back face of the fixation base is 0.1 mm. The second bonding areas 68 are substantially rectangular minute areas disposed between the proximal end side corners of the third bonding areas 69 and the tapered portions 70, and each comprise a face where the clearance from the back face of the fixation base is 0.2 mm. The third bonding areas 69 are rectangular areas disposed between the first bonding areas 67 and the air outlet 64, and each comprise a face where the clearance from the back face of the fixation base is 0.04 mm.

Therefore, also in the present embodiment, in the bonding areas 63, the clearance from the back face of the fixation base 6 is narrowed stepwise from the adhesive inlets 62 toward the air outlet 64, and the capillary force of the adhesive becomes stronger with distance from the adhesive inlets 62.

Next, the procedure for bonding the vibrator unit 2 in the housing space 27 will be described. This procedure is roughly the same as that of the first embodiment.

Figure 16A:
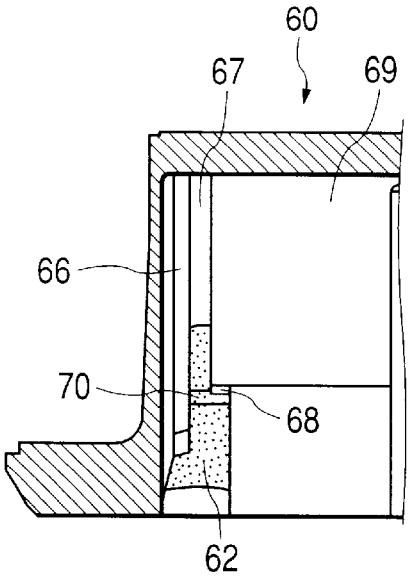
FIG. 16A to 16D are views explaining the filling state of the adhesive in the second embodiment.

That is, after the vibrator unit 2 is housed in the housing space 27 and positioned, the adhesive is poured in the adhesive inlets 62, and the case 60 is turned upside down (the state of FIG. 16A). Since the adhesive inlets 62 are provided with a capacity capable of holding a necessary amount of adhesive for filling the bonding areas 63, it can be made difficult for the adhesive to flow out even if the adhesive pouring speed is increased, so that pouring of the adhesive can be finished only once. Consequently, the time necessary for the bonding step can be reduced.

Figure 16B:
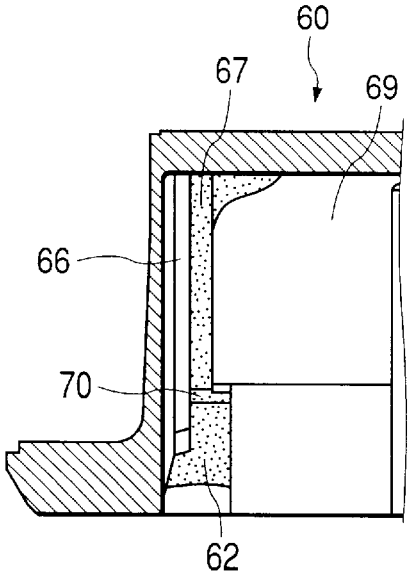
Figure 16C:
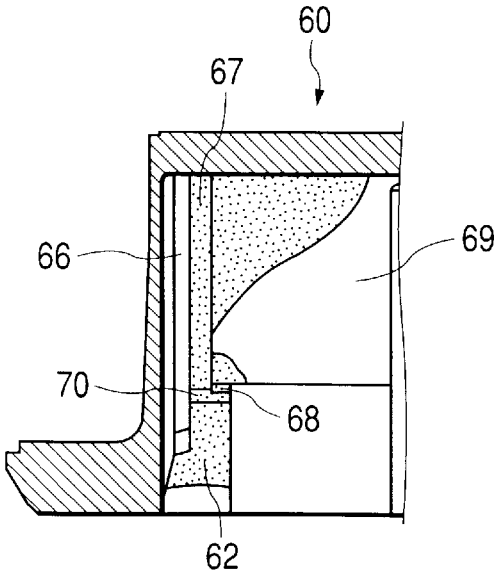
Figure 16D:
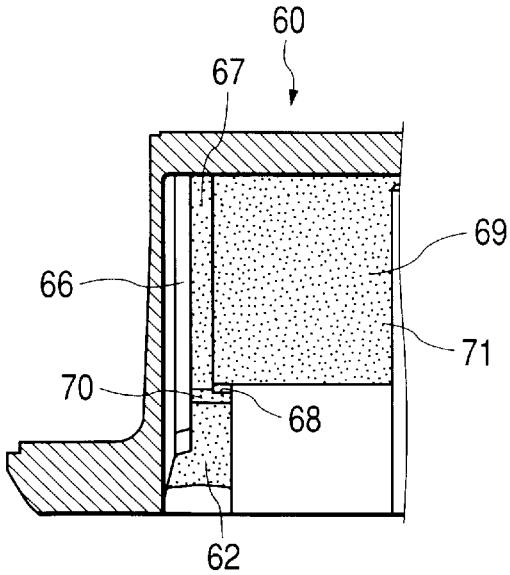

When the case 60 is inverted, the adhesive moves in the bonding areas 63 by a capillary force. At this time, since the capillary force in the first bonding areas 67 is stronger than that in the second bonding areas 68, first, the first bonding areas 67 are filled with the adhesive, and the adhesive flows into the third bonding areas 69 from the distal end side corners on the side closer to the first bonding areas 67 (the state of FIG. 16B). Then, in the third bonding areas 69, the adhesive flowing from the first bonding areas 67 gradually spreads. Moreover, the second bonding areas 68 are filled with the adhesive, and the adhesive flows into the third bonding areas 69 from the proximal end side corners on the side closer to the second bonding areas 68 (the state of FIG. 16C). Thereafter, the adhesive flows from the first bonding areas 67 and the second bonding areas 68 into the third bonding areas 69, and the influent adhesive moves toward the air outlet 64 side while expelling the air in the third bonding areas 69 by the capillary force. When the entire bonding areas 63 are filled (the state of FIG. 16D), the adhesive at the boundary with the air outlet 64 is held in a vent portion 71 by surface tension.

As described above, also in the present embodiment, the adhesive poured in the bonding areas 63 is gradually filled from the end of the area. With this, the adhesive can be filled while the air in the bonding areas 63 is expelled toward the air outlet 64 side, so that it can be prevented that bubbles remain in the bonding areas 63. Consequently, the behavior of the piezoelectric vibrators 8 can be made the same, so that ink drop jetting characteristics such as the flying speed and the ink amount can be stabilized.

While in the first embodiment and the second embodiment, the adhesive is filled from the lateral side edges of the bonding areas toward the air outlet side at the center in the horizontal direction, the present invention is not limited to this structure. For example, a structure may be used such that air outlets are disposed so as to face the lateral side edges of a bonding area, an adhesive inlet is disposed between the air outlets and the adhesive is filled from the center, in the horizontal direction, of the bonding area toward the lateral side edges. Hereinafter, a third embodiment having this structure will be described.

Figure 17:
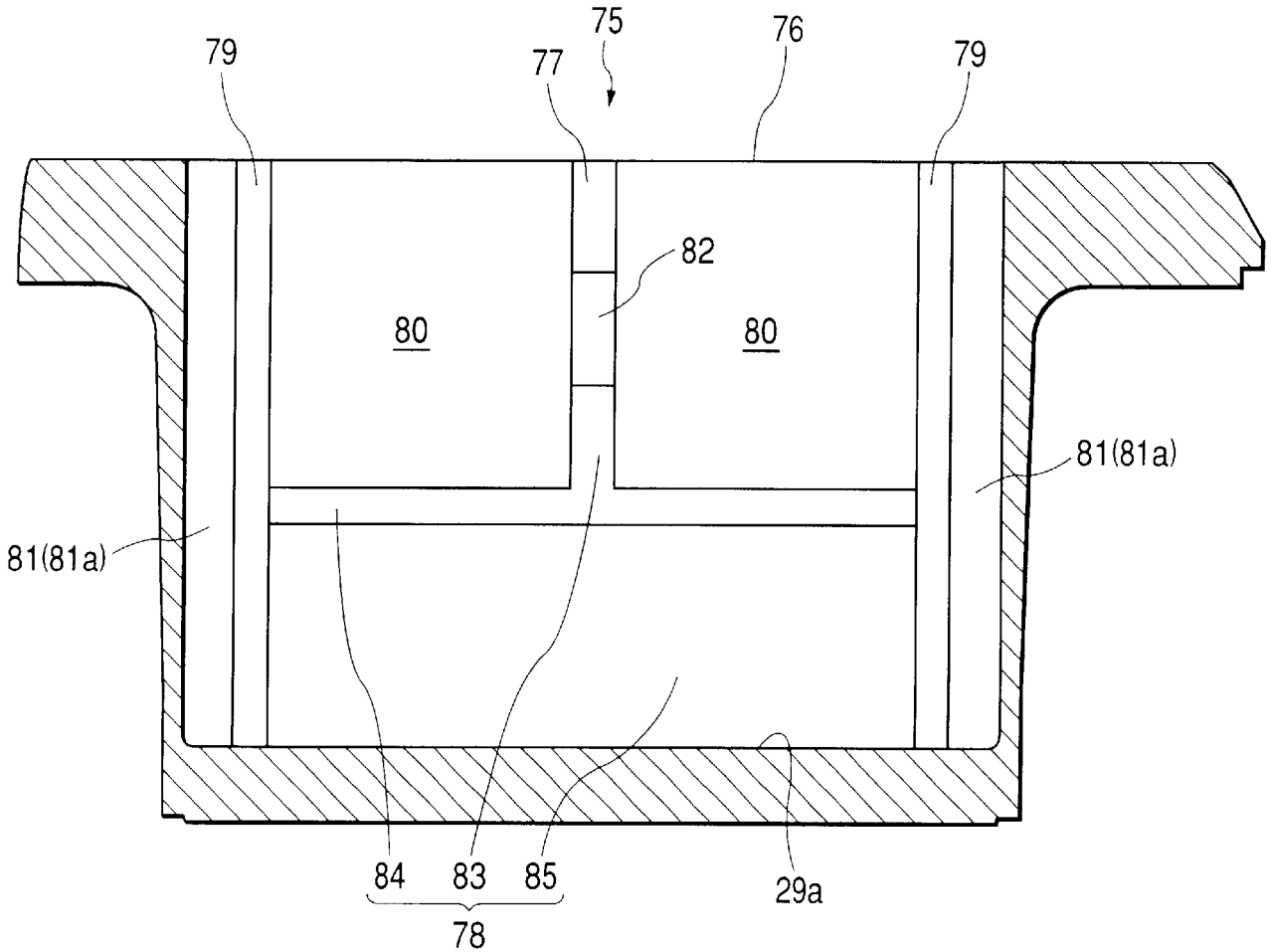
FIG. 17 is a cross-sectional view of a case according to a third embodiment of the invention.

As shown in FIG. 17, also in the third embodiment, a base bonding wall 76 of a case 75 is provided with an adhesive inlet 77, a bonding area 78, air outlets 79 and relief concave portions 80. In the present embodiment, positioning ribs 81 are disposed on the lateral ends of the housing space. The positioning ribs 81 are protrusions elongated in the height direction of the case 75 (that is, in the height direction of the bonding area 78), and the faces facing the fixation base 6 are reference faces 81*a* that are in close contact with the back face of the fixation base 6.

On each of the lateral inner sides of the positioning ribs 81, one air outlet 79 is disposed so as to adjoin the positioning rib 81. The air outlets 79 are each a concave groove where the clearance from the back face of the fixation base is 0.5 mm, and extend in the height direction of the case 75 like the positioning ribs 81. The distal ends of the air outlets 79 are flush with the bottom face 29*a* of the second housing space 29, and the proximal ends thereof reach the attachment face of the case 75.

The adhesive inlet 77 is a groove elongated in the height direction of the case 75, and is disposed in a position substantially at the center, in the horizontal direction, of an area sandwiched between the air outlets 79 (that is, between the positioning ribs 81) position of which is on the side of the attachment face of the case 75. In the adhesive inlet 77, an adhesive reservoir 82 is integrally provided. The adhesive reservoir 82 is provided with a capacity capable of holding the adhesive filled in the bonding area 78. In the present embodiment, the adhesive reservoir 82 is formed as a concave groove where the clearance from the back face of the fixation base is 0.5 mm.

The relief concave portions 80 are disposed in areas sandwiched between the adhesive inlet 77 and the air outlets 79. In the present embodiment, the relief concave portions 80 each comprise a rectangular area recessed so that the clearance from the back face of the fixation base is 1.3 mm.

The bonding area 78 comprises a first bonding area 83, a second bonding area 84 and a third bonding area 85. The first bonding area 83 is a groove formed so as to be continuous with the adhesive reservoir 82. The first bonding area 83 extends toward the distal end side of the case 75, and the distal end thereof is situated just at the midpoint in the height direction of the case 75 and connects with the second bonding area 84. The clearance from the back face of the fixation base 6 in the first bonding area 83 is narrower than that in the adhesive reservoir 82. In the present embodiment, the clearance is 0.2 mm. The second bonding area 84 is a strip-like groove extending rightward and leftward substantially at the midpoint in the height direction of the case 75. One end thereof connects with one air outlet 79, and the other end thereof connects with the other air outlet 79. The clearance from the back face of the fixation base 6 in the second bonding area 84 is provided so as to have the same area as that in the first bonding area 83. The third bonding area 85 is a rectangular area disposed between the second bonding area 84 and the bottom face 29*a* of the second housing space 29. The clearance from the back face of the fixation base 6 in the third bonding area 85 is narrower than those in the first bonding area 83 and the second bonding area 84. In the present embodiment, the clearance is 0.05 mm.

In the present embodiment, like in the above-described embodiments, the vibrator unit 2 is bonded in the housing space 27 by pouring the adhesive into the adhesive inlet 77 after the vibrator unit 2 is positioned.

Figure 18:
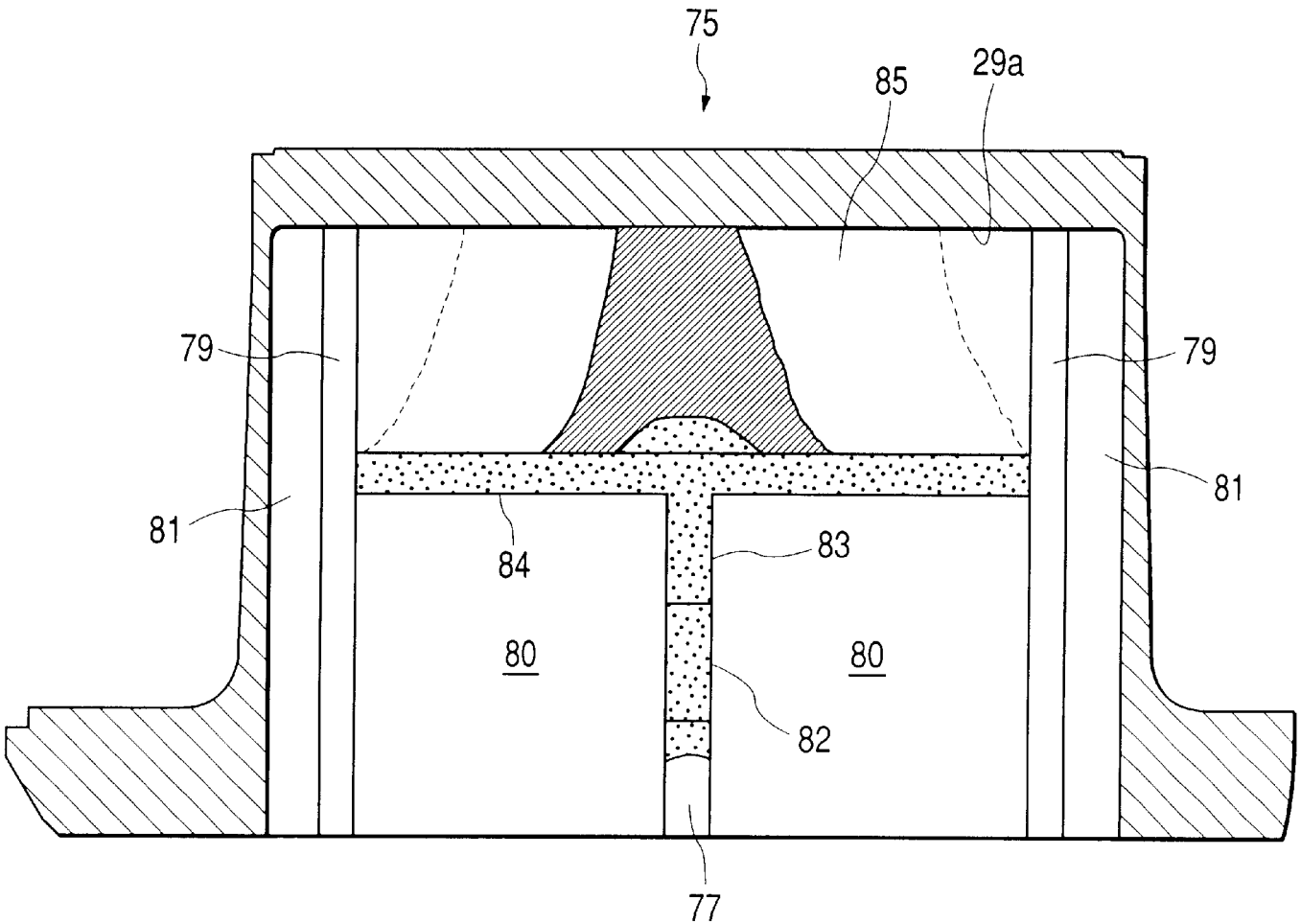
FIG. 18 is a view explaining the filling state of the adhesive in the third embodiment.

In this case, as shown in FIG. 18, the adhesive poured in the adhesive inlet 77, as shown by the dotted area, spreads to the first bonding area 83 and the second bonding area 84 and flows into the third bonding area 85 through the intersection of the first bonding area 83 and the second bonding area 84. Then, as shown by the shaded area, the adhesive spreads in a mountain-like shape convex to the distal end side in the third bonding area 85. Then, the adhesive further spreads in the third bonding area 85 as shown by the dotted lines, and is ultimately filled in the entire bonding area 78.

In this case, in the present embodiment, since the positioning ribs 81 are disposed outside the air outlets 79 and the reference faces 81*a* are in close contact with the back face of the fixation base 6, even if the adhesive flows out from the bonding area 78 toward the air outlets 79, the adhesive can be dammed. Consequently, problems caused by the leaking adhesive can be prevented.

As described above, in the present embodiment, the adhesive flowing from the center, in the horizontal direction, of the bonding area 78 spreads, both rightward and leftward, and the adhesive is filled while the air in the bonding area 78 is expelled toward the air outlets 79. Consequently, it can be prevented that bubbles remain in the bonding area 78, so that the behavior of the piezoeletric vibrators 8 can be made the same. As a result, ink drop jetting characteristics such as the flying speed and the ink amount can be stabilized.

In a large-size recording head 1 in which the number of piezoelectric vibrators 8 constituting the piezoelectric vibrator row 5 is large, similar effects are obtained by disposing side by side a plurality of pairs of adhesive inlets 77, bonding areas 78 (83, 84, 85), air outlets 79 and relief concave portions 80.

While in the above-described embodiments, the adhesive is filled between the lateral side edges of the bonding area and the center in the horizontal direction, the present invention is not limited to this structure. For example, a structure may be used such that an adhesive inlet is disposed so as to face one of either the right or left side edges of a bonding area, an air outlet is disposed so as to face the other of the right or left side edges of the bonding area and the adhesive is filled from one side edge to the other side edge of the bonding area. Hereinafter, a fourth embodiment having this structure will be described.

Figure 19A:
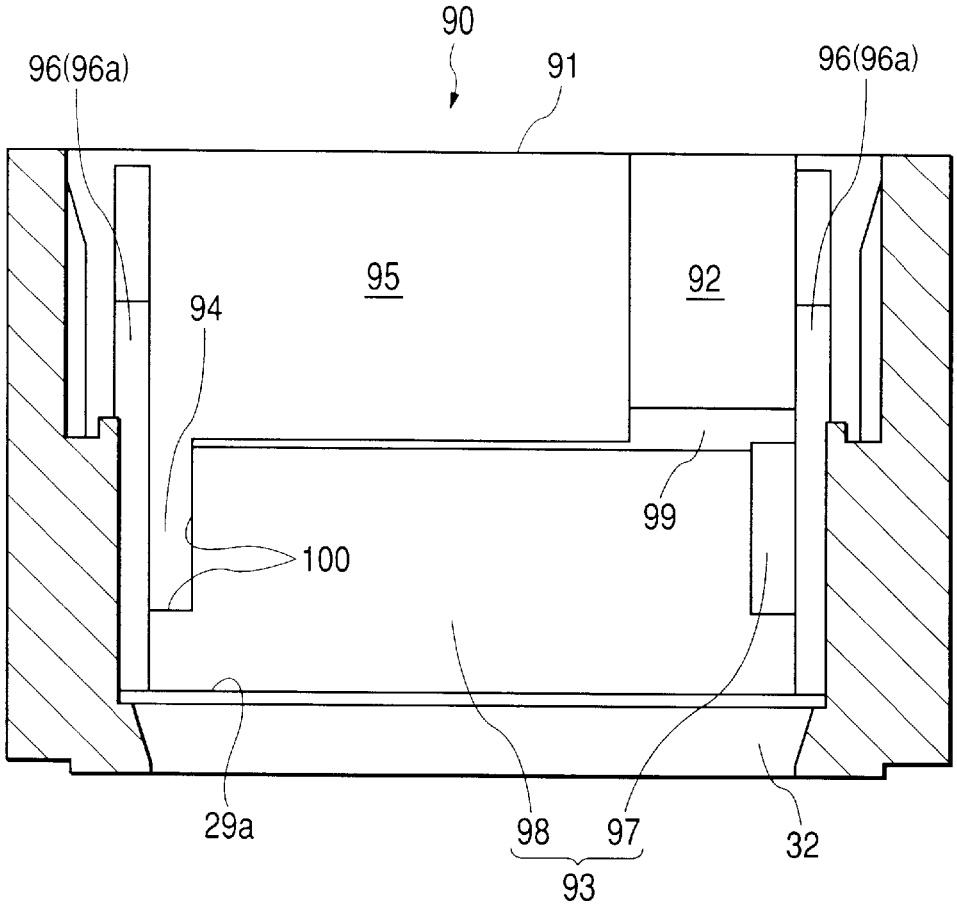
FIG. 19A and 19B are views explaining a case according to a fourth embodiment of the invention.
Figure 19B:
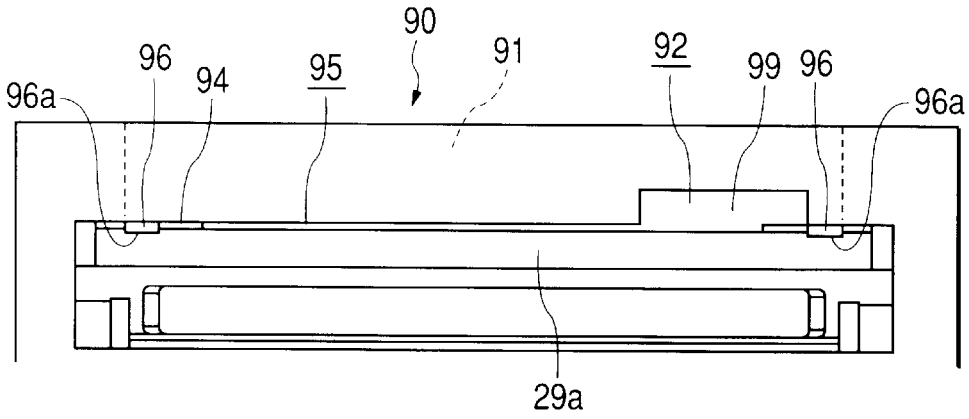

As shown in FIG. 19, a base bonding wall 91 of a case 90 is provided with an adhesive inlet 92, a bonding area 93, an air outlet 94 and a relief concave portion 95. The adhesive inlet 92 is disposed so as to face one of either the right or left sides (the right side in the figure) of the bonding area 93. The air outlet 94 is disposed on the other of the right or left sides (the left side in the figure) of the bonding area 93. A pair of positioning ribs 96 are formed so as to extend in the height direction of the case 90 (that is, in the height direction of the bonding area 93) and to adjoin the lateral side edges of the bonding area 93. The positioning ribs 96 are also protrusions for positioning the fixation base 6. These positioning ribs 96 are also protrusions for positioning the fixation base 6. The faces facing the fixation base 6 are reference faces 96*a* that are in close contact with the back face of the fixation base 6.

The adhesive inlet 92 is an angular recess formed substantially from the center, in the height direction, of the case 90 to the proximal end side, and is disposed between the positioning ribs 96. Since the reference faces 96*a* of the positioning ribs 96 and the back face of the fixation base 6 are also in close contact with each other in the present embodiment, the adhesive poured from the adhesive inlet 92 is dammed, so that the problem wherein the adhesive flows out over the positioning ribs 96 can be prevented.

The adhesive inlet 92 comprises a recess where the clearance from the back face of the fixation base is 1.0 mm, and also serves as an adhesive reservoir. That is, the adhesive inlet 92 is provided with a capacity capable of holding a necessary amount of adhesive for filling up the bonding area 93. The rectangular relief concave portion 95 adjoins the lateral inner sides of the adhesive inlet 92. The relief concave portion 95 comprises a recess where the clearance from the back face of the fixation base is 0.25 mm.

The bonding area 93 comprises a first bonding area 97 and a second bonding area 98. A tapered portion 99 inclined toward the first bonding area 97 and the second bonding area 98 is disposed between the adhesive inlet 92 and the first bonding area 97 and between the adhesive inlet 92 and the second bonding area 98. The adhesive inlet 92 and the first bonding areas 97 and the second bonding areas 98 are linked through the tapered portion 99.

The first bonding area 97 is a rectangular area elongated in the height direction of the case 90, and comprises a face where the clearance from the back face of the fixation base is 0.25 mm. The first bonding area 97 is formed so as to adjoin the positioning rib 96 that is on the side of the adhesive inlet 92. The proximal end thereof is in contact with the tapered portion 99, and the distal end thereof is situated slightly away from the bottom face 29*a* of the second housing space 29. The distal end and the lateral inner edges of the first bonding area 97 connect with the second bonding area 98.

The second bonding area 98 is a hat-shaped area where the distal end is slightly wider than the remaining part, and comprises a face where the clearance from the back face of the fixation base is 0.05 mm. The first bonding area 97 adjoins one of either the right or left sides of the second bonding area 98, and the air outlet 94 adjoins the other of the right or left sides of the second bonding area 98.

Therefore, also in the present embodiment, in the bonding area 93, the clearance from the back face of the fixation base 6 is narrowed stepwise from the adhesive inlet 92 toward the air outlet 94, and the capillary force of the adhesive becomes stronger with distance from the adhesive inlet 92.

The air outlet 94 is a linear concave groove formed from a protruding part on the distal end side of the second bonding area 98 to the relief concave portion in the height direction of the case 90, and is disposed on the lateral inner sides of the positioning ribs 96. Therefore, even if the adhesive flows into the air outlet 94, the adhesive can be dammed; so that the problem wherein the adhesive flows out over the positioning ribs 96 can be prevented.

The air outlet 94 comprises a face where the clearance from the back face of the fixation base is 0.25 mm. Consequently, a 0.05-mm-wide slit corresponding to the clearance of the second bonding area 98 is formed at the boundary between the air outlet 94 and the second bonding area 98, and the slit serves as a vent portion 100. The gap of the vent portion 100, that is, the width of the slit is such that the adhesive filling the second bonding area 98 is held by surface tension. This prevents the problem wherein the adhesive in the bonding area 93 flows into the air outlet 94.

Next, the procedure for bonding the vibrator unit 2 in the housing space 27 will be described.

Also in the present embodiment, first, the vibrator unit 2 is housed in the housing space 27 and positioned, and then, the adhesive is poured into the adhesive inlet 92. In the present embodiment, one adhesive inlet 92 corresponds to one vibrator unit 2. Therefore, even when a plurality of vibrator units 2 are provided, it is enough to face the nozzle of the adhesive feeder toward the adhesive inlet 92 only from one direction. Consequently, the degree of freedom of the apparatus layout in the manufacturing line increases. In addition, it is easy to face the nozzle toward the adhesive inlet 92.

Figure 20:
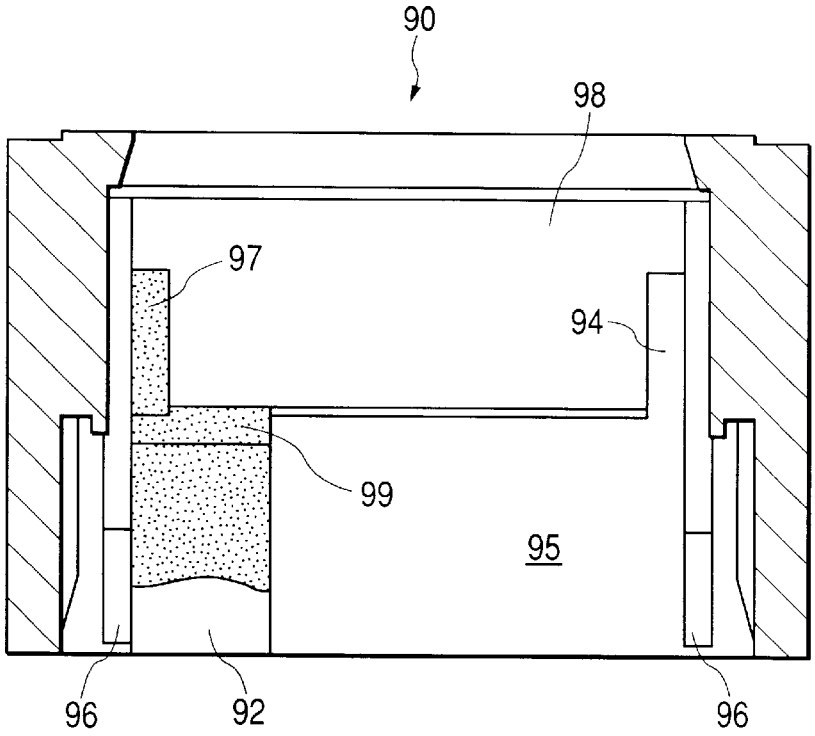
FIG. 20 is a view explaining the state immediately after the adhesive is poured in the fourth embodiment.
Figure 21:
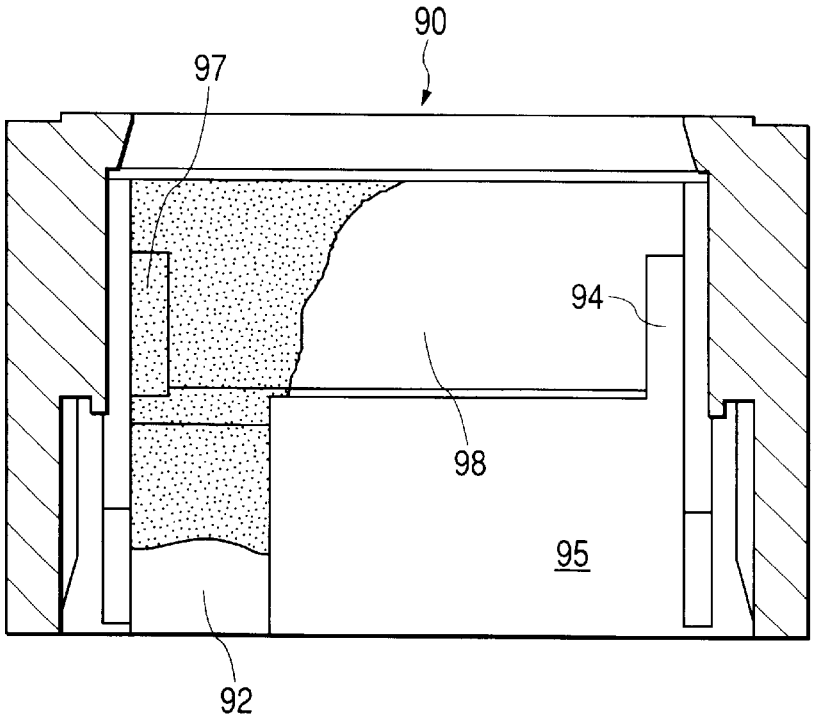
FIG. 21 is a view explaining how the poured adhesive is filled in a second bonding area in the fourth embodiment.

After the adhesive is poured, the case 90 is turned upside down. At this time, first, the first bonding area 97 and the tapered portion 99 are filled up with the adhesive (the state of FIG. 20). Then, when the case 90 is inverted, the adhesive moves in the second bonding area 98 by a capillary force. That is, the adhesive flows into the second bonding area 98 from an edge of the first bonding area 97 and an edge of the tapered portion 99 (the state of FIG. 21). Then, the adhesive moves in the second bonding area 98 toward the air outlet 94 side. With this arrangement, the air in the second bonding area 98 is discharged through the vent portion 100 and the like. Consequently, the adhesive can reliably be filled in the second bonding area 98 without any bubbles remaining in the bonding areas.

Figure 22:
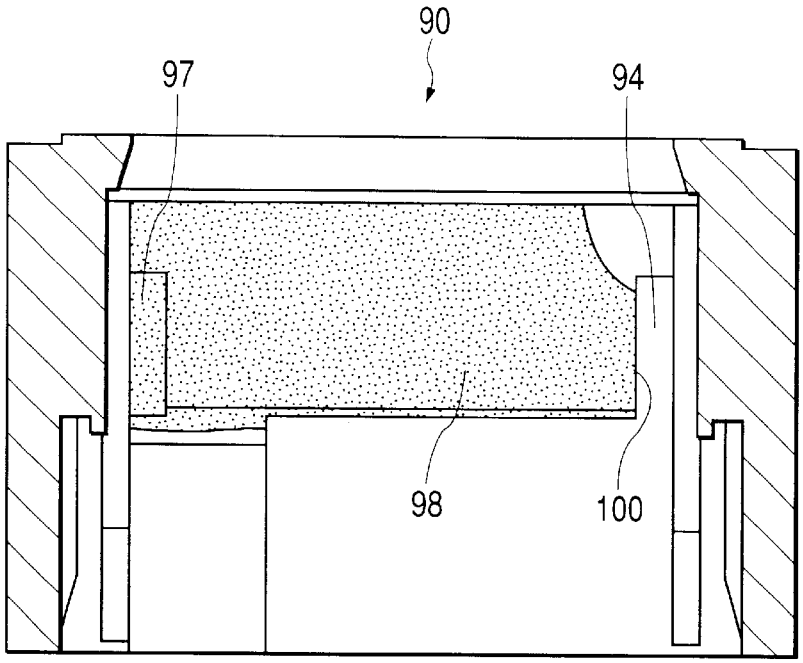
FIG. 22 is a view explaining the state where the adhesive reaches an air outlet in the fourth embodiment.

The adhesive moving in the second bonding area 98 first reaches the longer side of the vent portion 100. Since the vent portion 100 is as narrow as 0.05 mm, the adhesive does not move over the vent portion 100 to the air outlet 94 side. Therefore, as shown in FIG. 22, the adhesive is filled toward the distal end side corner of the second bonding area 98.

Figure 23:
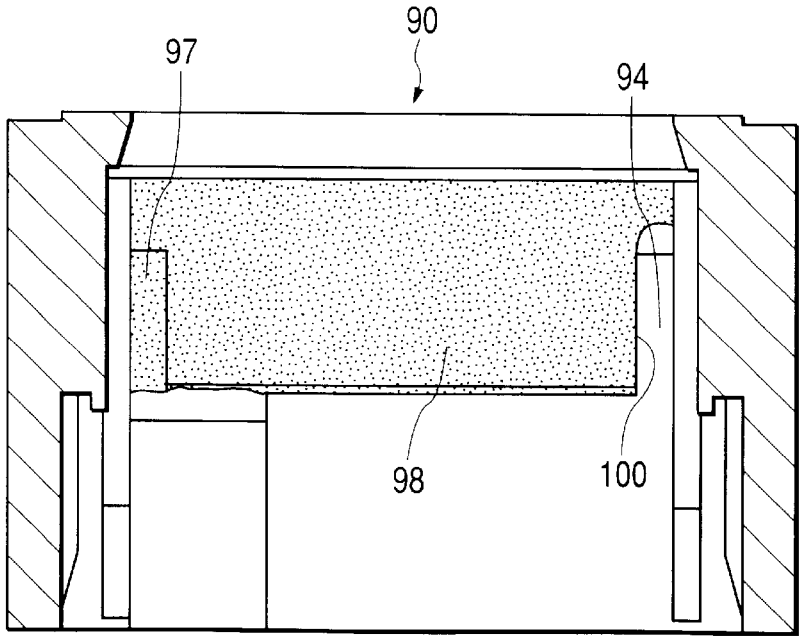
FIG. 23 is a view explaining the state where the adhesive is filled to a corner of the second bonding area in the fourth embodiment.
Figure 24:
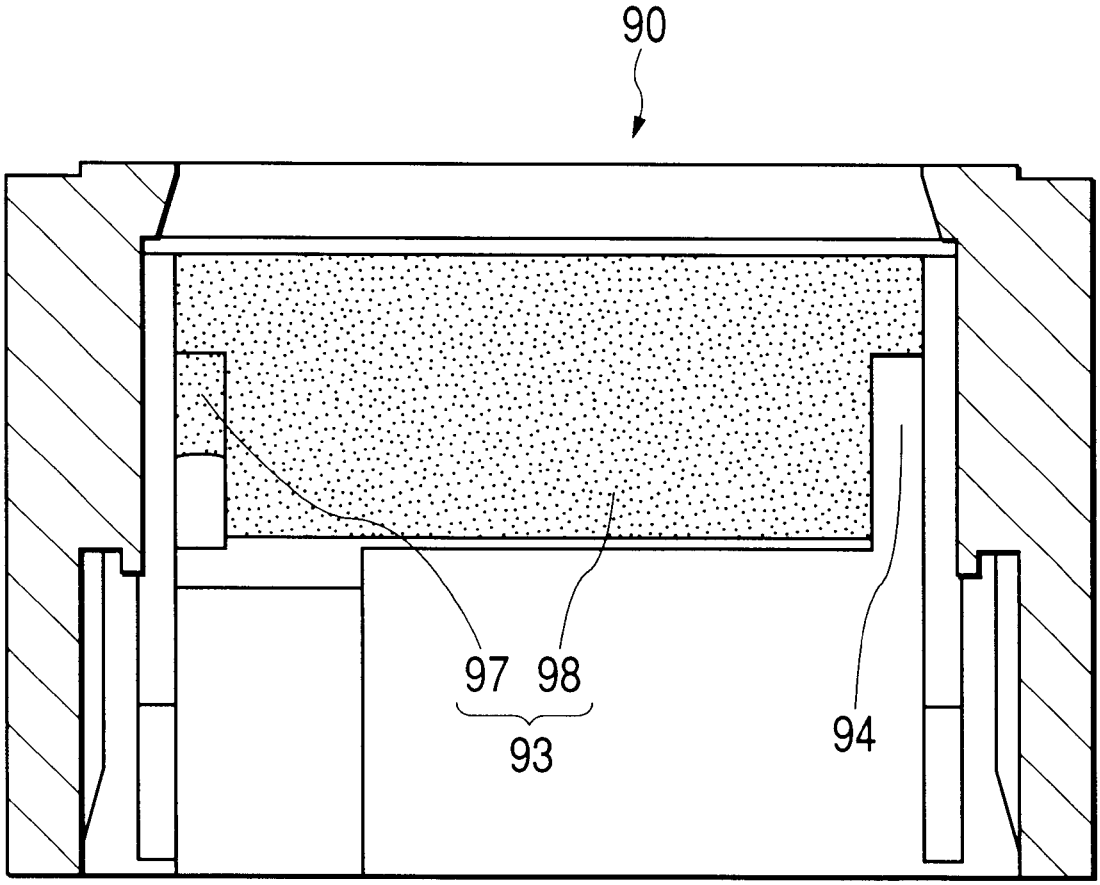
FIG. 24 is a view explaining the state where the adhesive is filled in the entire second bonding area in the fourth embodiment.

Then, the adhesive is filled to the distal end side corner of the second bonding area 98 (the state of FIG. 23), and is filled in the entire second bonding area 98 while air is expelled toward the shorter side of the vent portion 100 (the state of FIG. 24).

As described above, also in the present embodiment, the adhesive poured in the bonding area 93 is gradually filled from an end of the area. With this, the adhesive can be filled while the air in the bonding area 93 is expelled toward the air outlet 94 side, so that it can be prevented that bubbles remain in the bonding area 94. Consequently, the behavior of the piezoelectric vibrators 8 can be made the same, so that ink drop jetting characteristics such as the flying speed and the ink amount can be stabilized.

The present invention is not limited to the above described embodiments, but various modifications are possible based on the appended claims.

For example, while in the above-described embodiments, structures in which the distance from the bonding face of the base bonding wall to the bonding face of the fixation base 6 is varied stepwise are shown as examples, the distance may be continuously varied.

While in the above-described embodiments, the cases 3, 60, 75 and 90 are turned upside down after the adhesive is poured so that the adhesive is filled by a capillary force, the present invention is not limited to this configuration. For example, a configuration may be used such that the cases 3, 60, 75 and 90 are not turned upside down after the adhesive is poured.

In the structure in which the curved recess 33 is provided in the distal end face bonding portion 32, the effects can be enhanced by turning the case upside down after the adhesive is poured.

What is claimed is:

1. An ink jet recording head, comprising:

a vibrator unit, in which a plurality of piezoelectric vibrators are arranged on a base member in a cantilevered manner;

a case, formed with a housing space having a bonding area at which a first inner portion of the housing space and a first face of the base member are opposed with a gap;

at least one adhesive inlet, from which an adhesive is poured, the adhesive inlet communicating with the bonding area; and at least one air outlet, from which air remaining in the bonding area is expelled as the poured adhesive fills the gap.

2. The ink jet recording head as set forth in claim 1, wherein a pair of adhesive inlets are disposed so as to face both lateral side edge portions of the bonding area, and the air outlet is disposed between the adhesive inlets.

3. The ink jet recording head as set forth in claim 1, wherein a pair of air outlets are disposed so as to face both lateral side edge portions of the bonding area, and the adhesive inlet is disposed between the air outlets.

4. The ink jet recording head as set forth in claim 1, wherein the adhesive inlet is disposed so as to face one lateral side edge portion of the bonding area, and the air outlet is disposed so as to face the other lateral side edge portion of the bonding area.

5. The ink jet recording head as set forth in claim 1, wherein a dimension of the gap is so determined as to establish capillarity from the adhesive inlet to the air outlet.

6. The ink jet recording head as set forth in claim 5, wherein the dimension of the gap is reduced as being away from the adhesive inlet and being close to the air outlet.

7. The ink jet recording head as set forth in claim 1, wherein:

a pair of rib members extending in a vertical direction is formed in the housing space, and disposed both lateral sides of the bonding area;

each of the rib members has a face which is in close contact with the first face of the base member; and the adhesive inlet is disposed between the rib members.

8. The ink jet recording head as set forth in claim 1, further comprising an adhesive reservoir provided between the adhesive inlet and the bonding area in order to store the poured adhesive temporarily.

9. The ink jet recording head as set forth in claim 8, wherein a capacity of the adhesive reservoir is so determined as to store an amount of adhesive which is enough to fill the gap in the bonding area.

10. The ink jet recording head as set forth in claim 1, wherein a dimension of the gap at a portion where the bonding area communicates with the air outlet is determined such that the adhesive is held thereat due to surface tension thereof.

11. The ink jet recording head as set forth in claim 1, wherein:

a second inner portion of the housing space which situates an upper portion of the first inner portion is retracted so as to be away from the base member fixed on the first inner portion, to form a non-bonding area; and a top portion of the first inner portion is tapered so as to continue to the non-bonding area so that the gap thereat is enlarged toward the non-bonding area, thereby filling condition of the poured adhesive in the tapered portion can be externally confirmed.

12. The ink jet recording head as set forth in claim 1, wherein:

a third inner portion of the housing space which faces the piezoelectric vibrators is protruded from the first inner portion so as to form a step portion on which a second face of the base member is bonded; and a corner portion of the step portion which is closer to the piezoelectric vibrators is recessed so as to be away from the piezoelectric vibrators.

13. The ink jet recording head as set forth in claim 12, wherein a part of the second face of the base member which faces the recessed corner portion of the step portion is recessed so as to be away from the corner portion.

* * * * *